US008356986B2

(12) United States Patent
Higashi et al.

(10) Patent No.: US 8,356,986 B2
(45) Date of Patent: Jan. 22, 2013

(54) COMPRESSOR

(75) Inventors: Hirofumi Higashi, Sakai (JP); Kazuhiro Furusho, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 555 days.

(21) Appl. No.: 12/523,297

(22) PCT Filed: Jan. 10, 2008

(86) PCT No.: PCT/JP2008/050194

§ 371 (c)(1),
(2), (4) Date: Jul. 15, 2009

(87) PCT Pub. No.: WO2008/087887

PCT Pub. Date: Jul. 24, 2008

(65) Prior Publication Data

US 2010/0111737 A1 May 6, 2010

(30) Foreign Application Priority Data

Jan. 17, 2007 (JP) ..... 2007-008219

(51) Int. Cl.
*F03C 2/00* (2006.01)
*F03C 4/00* (2006.01)
*F04C 14/18* (2006.01)

(52) U.S. Cl. ..... 418/29; 418/11; 418/23; 418/60; 417/307; 417/310

(58) Field of Classification Search ..... 418/11, 418/60, 63, 270, 23, 29; 417/228, 310, 307, 417/284, 440
See application file for complete search history.

(56) References Cited

U.S. PATENT DOCUMENTS 2,904,973 A * 9/1959 Kosfeld ..... 417/310

FOREIGN PATENT DOCUMENTS

| | | | | |
|---|---|---|---|---|
| EP | 1992820 | A1 | * | 11/2008 |
| JP | 58-183466 | U | | 12/1983 |
| JP | 58214696 | A | * | 12/1983 |
| JP | 59-012264 | A | | 1/1984 |
| JP | 60-27798 | A | | 2/1985 |
| JP | 60-82596 | U | | 6/1985 |
| JP | 63016191 | A | * | 1/1988 |
| JP | 2000-073974 | A | | 3/2000 |
| JP | 2003-148365 | A | | 5/2003 |
| JP | 2007-239666 | | * | 9/2007 |

OTHER PUBLICATIONS

Chinese Office Action mailed Mar. 24, 2011 for the corresponding Chinese Patent Application No. 200880002414.0.

* cited by examiner

*Primary Examiner* — Theresa Trieu
(74) *Attorney, Agent, or Firm* — Global IP Counselors

(57) ABSTRACT

A compressor includes a compression mechanism having two opposed end plates, a fixed member disposed between the two end plates, a movable member disposed between the two end plates, a bypass passage, and an opener/closer. The movable member is arranged to eccentrically move about a predetermined rotational axis to compress refrigerant in a compression chamber formed between the fixed member and the movable member. The bypass passageway has an upstream end opened to the compression chamber through which refrigerant is partially ejected from the compression chamber so as to be returned to a suction side of the compression mechanism. The cross section of the upstream end of the bypass passage is preferably elongated circumferentially about the rotational axis. The compression mechanism may include a plurality of bypass passages and a plurality of openers/closers.

7 Claims, 8 Drawing Sheets

0 degree 45 degrees 90 degrees 135 degrees 180 degrees 225 degrees 270 degrees 315 degrees
39
40a
42a-Hp
42a-Lp
47a
48a
49a
61
62
X
Y
Z

COMPRESSOR

CROSS-REFERENCE TO RELATED APPLICATIONS

This U.S. National stage application claims priority under 35 U.S.C. §119(a) to Japanese Patent Application No. 2007-008219, filed in Japan on Jan. 17, 2007, the entire contents of which are hereby incorporated herein by reference.

TECHNICAL FIELD

The present disclosure relates to compressors including a compression mechanism whose volume can be changed by partially ejecting, through a bypass passage, refrigerant in a compression chamber.

BACKGROUND ART

There have been conventionally known compressors which are provided with a bypass passage allowing communication between a compression chamber and a suction side of the compressor and whose volume is controlled by partially returning refrigerant in the compression chamber through the bypass passage to the suction side.

For example, for a compressor disclosed in Japanese Unexamined Patent Application Publication No. 59-12264, a bypass passage passes through the sidewall of a cylinder, and an upstream end of the bypass passage is opened in the inner circumferential surface of the cylinder. When the bypass passage is closed by an opening/closing mechanism placed somewhere along the bypass passage, this closing allows compression of the entire refrigerant sucked into a compression mechanism, resulting in discharge of the compressed refrigerant. On the other hand, when the bypass passage is opened by the opening/closing mechanism, the refrigerant sucked into the compression chamber partially flows out into the bypass passage, and only the remaining part of the refrigerant is compressed, resulting in discharge of the compressed refrigerant.

SUMMARY OF THE INVENTION

Problems That the Invention is to Solve

Incidentally, when an opening of the bypass passage has a small area, this condition prevents a sufficient bypass flow from being ensured, resulting in difficulties in adjusting the compressor volume as desired. More particularly, when the bypass passage is opened, the containment of refrigerant in the compression chamber is completed at the time when a piston blocks the opening of the bypass passage. For this reason, the opening location at which the bypass passage is opened is determined so that when the piston blocks the opening of the bypass passage, the compression chamber has a desired volume. In spite of this design, if the opening of the bypass passage has a small area, the compression of the refrigerant in the compression chamber progresses to some extent at the time when the piston blocks the opening of the bypass passage so that the containment of the refrigerant in the compression chamber is completed. It appears that this state coincides with the state in which before the piston blocks the bypass passage, the containment of the refrigerant in the compression chamber is completed and subsequently the refrigerant is compressed to some extent. In other words, although the opening location of the bypass passage has been designed so that at the time when the piston blocks the bypass passage, the compression chamber has a desired volume, the actual suction volume of the compression chamber becomes larger than a designed value.

Usually, the bypass passage is drilled or made by any other tool to form a circular cross-section bore. The bore cannot have a very large diameter due to the sizes of members for defining the compression chamber. For example, when the bypass passage is opened in the inner circumferential surface of the cylinder, the diameter of the opening of the bypass passage cannot be greater than the cylinder height.

The present invention is made in view of the above-mentioned problems, and its objective is to ensure a sufficient area of an opening of a bypass passage that is opened to the compression chamber.

Means of Solving the Problems

A first aspect of the invention is directed to a compressor which includes a compression mechanism (40*a*, 240*b*, 340*a*) including two end plates (45, 46, 244, 246) each having a flat surface and disposed with the corresponding flat surfaces opposed, a fixed member (41*a*, 41*b*, 341*a*) disposed between the two end plates (45, 46, 244, 246), and a movable member (47*a*, 47*b*) disposed between the two end plates (45, 46, 244, 246) and eccentrically rotating about a predetermined rotational axis (X) and in which a compression chamber (42*a*, 42*b*) is formed between the fixed member (41*a*, 41*b*, 341*b*) and the movable member (47*a*, 47*b*). The compression mechanism (40*a*, 240*b*, 340*a*) is configured to compress refrigerant in the compression chamber (42*a*, 42*b*). The compression mechanism (40*a*, 240*b*, 340*a*) is provided with a bypass passage (66, 266, 366) whose upstream end is opened to the compression chamber (42*a*, 42*b*) and through which refrigerant is partially ejected from the compression chamber (42*a*, 42*b*) so as to be returned to a suction side of the compression mechanism (40*a*, 240*b*, 340*a*). The compressor further includes an opener/closer for opening/closing the bypass passage (66, 266, 366). A cross section of the upstream end of the bypass passage (66, 266, 366) is elongated circumferentially about the rotational axis (X).

For the above-described configuration, an opening of the bypass passage (66, 266, 366) is elongated circumferentially about the rotational axis (X), thereby increasing the area of the opening of the bypass passage (66, 266, 366). More particularly, in the compression chamber (42*a*, 42*b*) formed between the fixed member (41*a*, 41*b*, 341*a*) and the eccentrically rotating movable member (47*a*, 47*b*), the extension of the bypass passage (66, 266, 366) along a radial direction from the rotational axis (X) and along the rotational axis (X) is likely to be limited due to the size or other elements of the compression chamber (42*a*, 42*b*). This makes it difficult to expand the opening of the bypass passage (66, 266, 366). On the other hand, since the compression chamber (42*a*, 42*b*) is formed to extend circumferentially about the rotational axis (X), this facilitates extending the opening of the bypass passage (66, 266, 366) circumferentially. In view of the above, the cross section of the upstream end of the bypass passage (66, 266, 366) does not form a circular shape but forms an elongated shape extending circumferentially about the rotational axis (X). This can increase the area of the opening of the bypass passage (66, 266, 366). As a result, when refrigerant in the compression chamber (42*a*, 42*b*) is partially ejected from the compression chamber (42*a*, 42*b*), a sufficient ejection flow can be ensured, thereby easily adjusting the volume of the compression chamber (42*a*, 42*b*) to a desired value.

Herein, the term "elongated circumferentially" does not need to mean a shape in which the opening extends strictly circumferentially, includes a shape in which the opening extends orthogonally to a radial direction and means a shape in which the circumferential dimension of the opening is longer than the radial or axial dimension thereof.

According to a second aspect of the invention, in the first aspect of the invention, the cross section of the upstream end of the bypass passage (62, 262, 362) may be curved along a circumferential direction about the rotational axis (X).

For the above-described configuration, the cross section of the upstream end of the bypass passage (62, 262, 362) may be curved along a circumferential direction about the rotational axis (X), thereby increasing the cross section of the upstream end of the bypass passage (62, 262, 362) not along a radial direction from the rotational axis (X) or along the axis (X) but circumferentially. As a result, the area of the opening of the bypass passage (62, 262, 362) opened to the compression chamber (42*a*, 42*b*) can be increased.

According to a third aspect of the invention, in the first aspect of the invention, the cross section of the upstream end of the bypass passage (62*b*) may form an elongated shape extending orthogonally to a radial direction from the rotational axis (X).

For the above-described configuration, the cross section of the upstream end of the bypass passage (62*b*) may form an elongated shape extending orthogonally to a radial direction from the rotational axis (X), thereby increasing the cross section of the upstream end of the bypass passage (62*b*) not along a radial direction from the rotational axis (X) or along the axis (X) but circumferentially. As a result, the area of the opening of the bypass passage (62*b*) opened to the compression chamber (42*a*, 42*b*) can be increased.

According to a fourth aspect of the invention, in the first aspect of the invention, the cross section of the upstream end of the bypass passage (62*c*) may form an oval shape whose major axis extends orthogonally to a radial direction from the rotational axis (X).

For the above-described configuration, the cross section of the upstream end of the bypass passage (62*c*) may form an oval shape whose major axis extends orthogonally to the radial direction from the rotational axis (X), thereby increasing the cross section of the upstream end of the bypass passage (62*c*) not along a radial direction from the rotational axis (X) or along the axis (X) but circumferentially. As a result, the area of the opening of the bypass passage (62*c*) opened to the compression chamber (42*a*, 42*b*) can be increased.

According to a fifth aspect of the invention, in the first aspect of the invention, an opening of the bypass passage (66, 266) may be formed in the end plate (45, 46, 244, 246).

For the above-described configuration, an arched compression chamber (42*a*, 42*b*) may be formed between the fixed member (41*a*, 41*b*) and the movable member (47*a*, 47*b*) to extend circumferentially about the rotational axis (X). More particularly, a part of the end plate (45, 46, 244, 246) facing the compression chamber (42*a*, 42*b*) may also extend circumferentially about the rotational axis (X) and may form a shape in which the circumferential length of the part of the end plate (45, 46, 244, 246) is greater than the length thereof along a radial direction from the rotational axis (X). In view of the above, as described above, the cross section of the upstream end of the bypass passage (66, 266) is elongated circumferentially about the rotational axis (X). Thus, even when the bypass passage (66, 266) is formed in the end plate (45, 46, 244, 246), the area of the opening of the bypass passage (66, 266) can be increased.

According to a sixth aspect of the invention, in the first aspect of the invention, the fixed member (341*a*) may form a cylindrical shape and have an inner circumferential surface being in sliding contact with the movable member (47*a*), and an opening of the bypass passage (366) may be formed in the inner circumferential surface of the fixed member (341*a*).

For the above-described configuration, the height of a part of the inner circumferential surface of the fixed member (341*a*) facing the compression chamber (42*a*) may be identical with that of the compression chamber (42*a*). Therefore, when the bypass passage (366) is formed in the fixed member (341*a*) such that its opening is foiined the inner circumferential surface of the fixed member (341*a*), there is a limit to the extension of the cross section of the upstream end of the bypass passage (366) along the height of the inner circumferential surface. To cope with this, as described above, the cross section of the upstream end of the bypass passage (366) may be elongated circumferentially about the rotational axis (X). Thus, also when the bypass passage (366) is formed in the fixed member (341*a*), the area of the opening of the bypass passage (366) can be increased.

A seventh aspect of the invention is directed to a compressor which includes a compression mechanism (440*a*) including two end plates (45, 46) each having a flat surface and disposed with the corresponding flat surfaces opposed, a fixed member (41*a*) disposed between the two end plates (45, 46), and a movable member (47*a*) disposed between the two end plates (45, 46) and eccentrically rotating about a predetermined rotational axis (X) and in which a compression chamber (42*a*) is formed between the fixed member (41*a*) and the movable member (47*a*). The compression mechanism (440*a*) is configured to compress refrigerant in the compression chamber (42*a*). The compression mechanism (440*a*) is provided with a plurality of bypass passages (466*a*, 466*b*) whose upstream ends are opened to the compression chamber (42*a*) and through which refrigerant in the compression chamber (42*a*) is partially ejected so as to be returned to a suction side of the compression mechanism (440*a*). The compressor further includes openers/closers for opening/closing the bypass passages (466*a*, 466*b*).

For the above-described configuration, the plurality of bypass passages (466*a*, 466*b*) may be opened to the compression chamber (42*a*). Therefore, even when the area of the opening of each bypass passage (466*a*, 466*b*) is not large, the provision of the plurality of bypass passages (466*a*, 466*b*) can increase the total area of the openings of the bypass passages (466*a*, 466*b*).

According to an eighth aspect of the invention, in the seventh aspect of the invention, the openers/closers may open and close the plurality of bypass passages (466*a*, 466*b*) individually.

For the above-described configuration, the plurality of bypass passages (466*a*, 466*b*) can be opened and closed individually by the plurality of openers/closers. The volume of the compression mechanism (440*a*) can be finely adjusted by controlling the opening/closing of the plurality of bypass passages (466*a*, 466*b*).

According to a ninth aspect of the invention, the compressor of the first or seventh aspect of the invention may further include: a low-stage side compression mechanism (40*a*, 240*a*, 340*a*, 440*a*) for compressing refrigerant sucked from outside; and a high-stage side compression mechanism (40*b*, 240*b*) for sucking refrigerant discharged from the low-stage side compression mechanism (40*a*, 240*a*, 340*a*, 440*a*) and compressing the sucked refrigerant. One of the low-stage side and high-stage side compression mechanisms may be formed of the compression mechanism (40*a*, 240*b*, 340*a*, 440*a*) including the bypass passage (66, 266, 366, 466).

The above-described configuration is directed to a so-called two-stage compressor. The volume of the compression mechanism (40*a*, 240*b*, 340*a*, 440*a*) can be changed by the bypass passage (66, 266, 366, 466) as described above. This allows the ratio between the suction volumes of the low-stage side and the high-stage side compression mechanisms to vary. As a result, the volume of the compression mechanism (40*a*, 240*b*, 340*a*, 440*a*) is adjusted according to the operating condition of the compressor, thereby adjusting the ratio between the suction volumes of the low-stage side and the high-stage side compression mechanisms. This adjustment can reduce vibrations of the compressor and improves the efficiency of an air conditioner to which the compressor is coupled.

Advantages of the Invention

According to an aspect of the present invention, the cross section of the upstream end of the bypass passage (66, 266, 366) forms an elongated shape extending circumferentially about the rotational axis (X). This can increase the area of the opening of the bypass passage (66, 266, 366) in the circular compression chamber (42*a*, 42*b*) formed between the fixed member (41*a*, 41*b*, 341*a*) and the movable member (47*a*, 47*b*). As a result, when refrigerant in the compression chamber (42*a*, 42*b*) is partially ejected from the compression chamber (42*a*, 42*b*), a sufficient ejection flow can be ensured, thereby easily adjusting the volume of the compression chamber (42*a*, 42*b*) to a desired value.

According to the second aspect of the invention, the cross section of the upstream end of the bypass passage (62, 262, 362) may be curved along a circumferential direction about the rotational axis (X), thereby increasing the area of the opening of the bypass passage (62, 262, 362).

According to the third aspect of the invention, the cross section of the upstream end of the bypass passage (62*b*) may form an elongated shape extending orthogonally to a radial direction from the rotational axis (X), thereby increasing the area of the opening of the bypass passage (62*b*).

According to the fourth aspect of the invention, the cross section of the upstream end of the bypass passage (62*c*) may form an oval shape whose major axis extends orthogonally to the radial direction from the rotational axis (X), thereby increasing the area of the opening of the bypass passage (62*c*).

According to the fifth aspect of the invention, the cross section of the upstream end of the bypass passage (66, 266) may be elongated circumferentially about the rotational axis (X). Thus, even when the bypass passage (66, 266) is formed in the end plate (45, 46, 244, 246), the area of the opening of the bypass passage (66, 266) can be increased.

According to the seventh aspect of the invention, the plurality of bypass passages (466*a*, 466*b*) are opened to the compression chamber (42*a*), thereby increasing the total area of the openings of the bypass passages (466*a*, 466*b*).

According to the eighth aspect of the invention, the plurality of bypass passages (466*a*, 466*b*) may be opened and closed individually by the plurality of openers/closers, thereby finely controlling the volume of the compression mechanism (440*a*).

According to the ninth aspect of the invention, the volume of the compression mechanism (40*a*, 240*b*, 340*a*, 440*a*) may be adjusted according to the operating condition of the compressor, thereby adjusting the ratio between the suction volumes of the low-stage side and the high-stage side compression mechanisms. This adjustment can reduce vibrations of the compressor and improves the efficiency of an air conditioner to which the compressor is coupled.

DETAILED DESCRIPTION OF THE INVENTION

Hereinafter, embodiments of the present invention will be described in detail with reference to the accompanying drawings.

<<Embodiment 1 of the Invention>>

Figure 2:
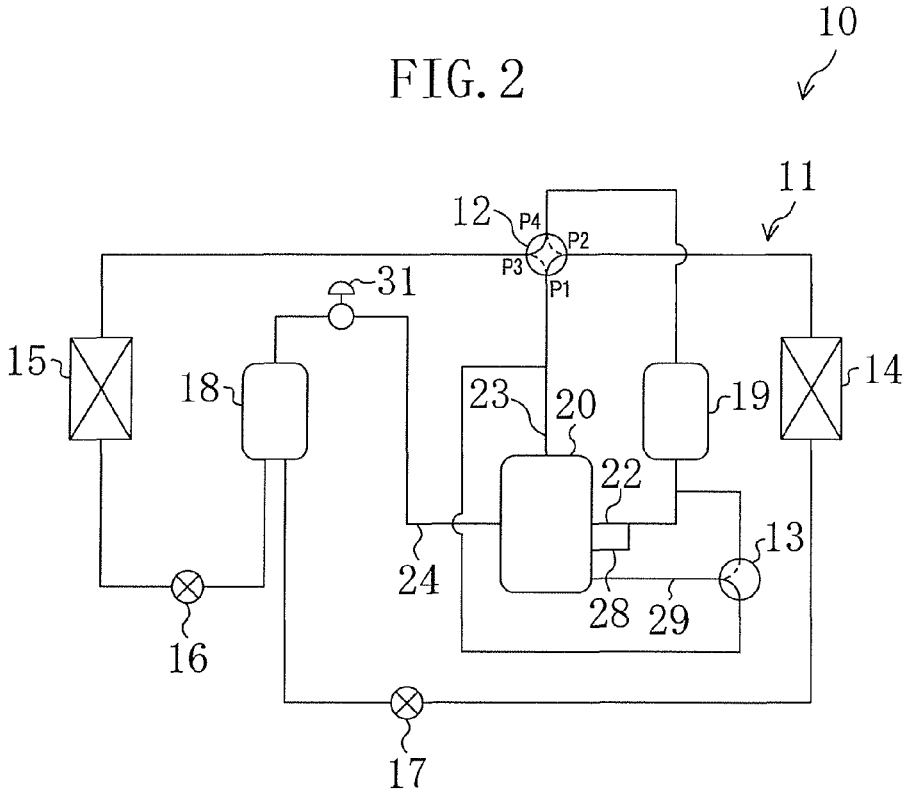
FIG. 2 is a refrigerant circuit diagram of an air conditioner.

As shown in FIG. 2, an air conditioner (10) according to a first embodiment of the present invention includes a two-stage compressor (20). The air conditioner (10) includes a refrigerant circuit (11).

The two-stage compressor (20), an outdoor heat exchanger (14), an indoor heat exchanger (15), a first expansion valve (16), a second expansion valve (17), a four-way selector valve (12), a three-way selector valve (13), a gas-liquid separator (18), and an accumulator (19) are coupled to the refrigerant circuit (11).

Particularly, a discharge side of the two-stage compressor (20) is coupled through a discharge pipe (23) to a first port of the four-way selector valve (12). A suction side of the two-stage compressor (20) is coupled through a suction pipe (22) to the bottom of the accumulator (19). The top of the accumulator (19) is coupled to a fourth port of the four-way selector valve (12). The outdoor heat exchanger (14) is coupled at one end thereof to a second port of the four-way selector valve (12) and at the other end thereof through the second expansion valve (17) to the bottom of the gas-liquid separator (18). The indoor heat exchanger (15) is coupled at one end thereof to a third port of the four-way selector valve (12) and at the other end thereof through the first expansion valve (16) to the bottom of the gas-liquid separator (18).

Furthermore, the refrigerant circuit (11) is provided with an injection pipe (24). The injection pipe (24) is coupled at one end thereof to the top of the gas-liquid separator (18) and at the other end thereof to the two-stage compressor (20). The injection pipe (24) is provided with an electromagnetic valve (31). When the electromagnetic valve (31) is opened, this allows the injection pipe (24) to lead intermediate-pressure gas refrigerant in the gas-liquid separator (18) into the two-stage compressor (20).

Moreover, the refrigerant circuit (11) is provided with a bypass pipe (28) and an inlet pipe (29). The bypass pipe (28)

is coupled at one end thereof to the two-stage compressor (20) and at the other end thereof to the suction pipe (22). The inlet pipe (29) is provided with a three-way selector valve (13) and coupled at one end thereof to the two-stage compressor (20) and at the other end thereof through the three-way selector valve (13) to a discharge pipe (23) and the suction pipe (22). The three-way selector valve (13) switches between the state in which the two-stage compressor (20) communicates with the discharge pipe (23) through the inlet pipe (29) (the state shown by the solid line in FIG. 2) and the state in which the two-stage compressor (20) communicates with the suction pipe (22) through the inlet pipe (29) (the state shown by the broken line in FIG. 2).

The four-way selector valve (12) switches between the state in which its first and second ports (P1) and (P2) communicate with each other and its third and fourth ports (P3) and (P4) communicate with each other (the state shown by the solid line in FIG. 2) and the state in which the first and third ports (P1) and (P3) communicate with each other and the second and fourth ports (P2) and (P4) communicate with each other (the state shown by the broken line in FIG. 2).

Figure 1:
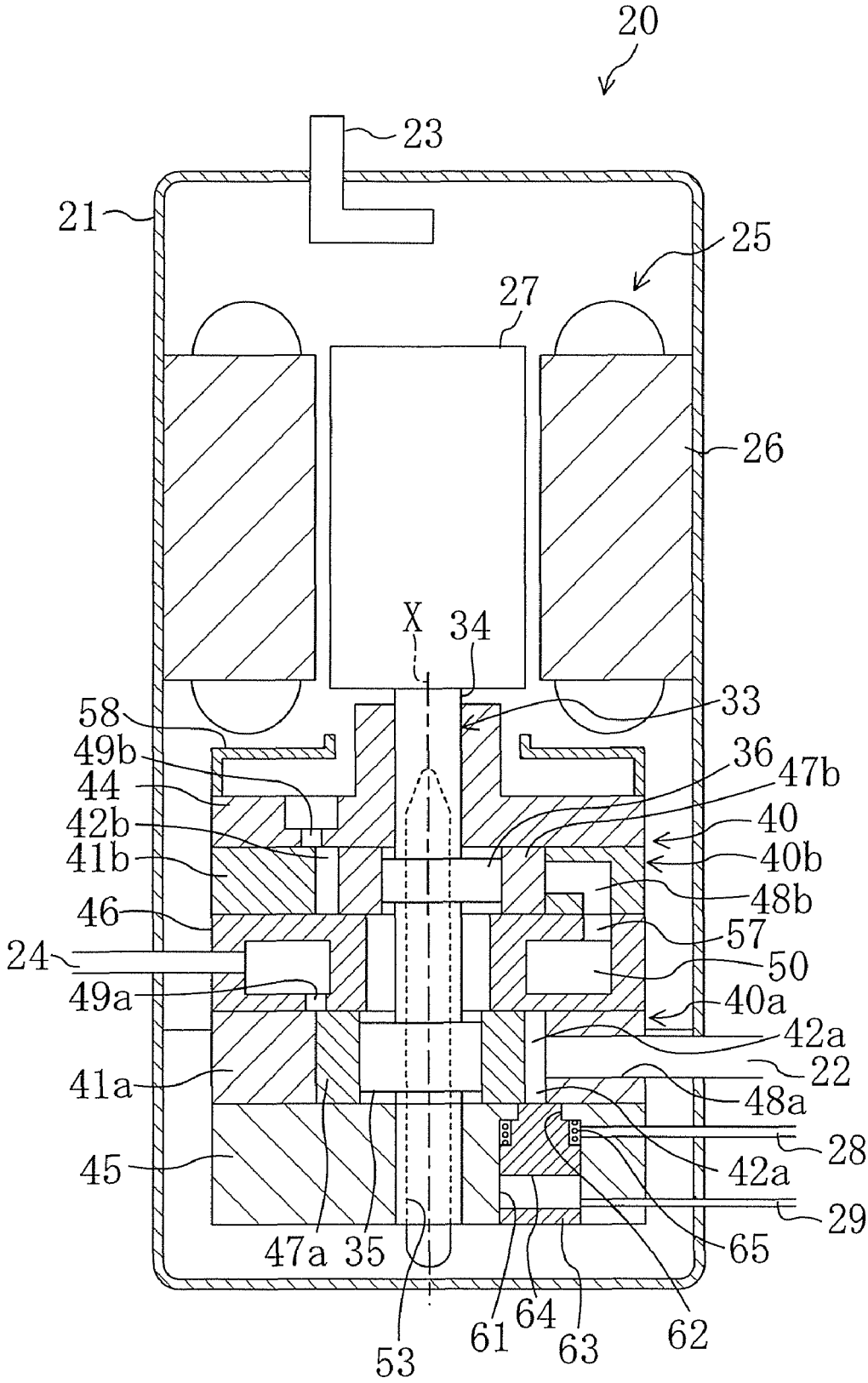
FIG. 1 is a longitudinal cross-sectional view of a two-stage compressor according to a first embodiment of the present invention.

Subsequently, the construction of the two-stage compressor (20) will be described. The two-stage compressor (20) is configured such that an electric motor (25) and a compression mechanism (40) including a low-stage compression mechanism (40*a*) and a high-stage compression mechanism (40*b*) are contained in such a vertically long cylindrical closed container as shown in FIG. 1, i.e., a casing (21). In the casing (21), the electric motor (25) is disposed above the compression mechanism (40).

The suction pipe (22), the injection pipe (24), the bypass pipe (28), and the inlet pipe (29) pass through the body of the casing (21) while the discharge pipe (23) passes through the top thereof. The discharge pipe (23) is opened in the manner in which its inlet side is bent in the casing (21) and extends horizontally.

The electric motor (25) includes a stator (26) and a rotor (27). The stator (26) is fixed on the inner circumferential surface of the casing (21). The rotor (27) is disposed inside the stator (26). A main shaft (34) of a vertically extending shaft (33) is coupled to the middle of the rotor (27).

The action of the electric motor (25) allows the shaft (33) to be driven while rotating about a predetermined rotational axis (X). The shaft (33) is formed with a first eccentric shaft (35) and a second eccentric shaft (36) in bottom-to-top order. The first and second eccentric shafts (35) and (36) each have a larger diameter than the main shaft (34) and are formed eccentrically to the rotational axis (X). The direction of eccentricity of the first eccentric shaft (35) is opposite to that of the second eccentric shaft (36). The height of the first eccentric shaft (35) is greater than that of the second eccentric shaft (36). The shaft (33) forms a drive shaft. The low-stage side compression mechanism (40*a*) is coupled to the first eccentric shaft (35) while the high-stage side compression mechanism (40*b*) is coupled to the second eccentric shaft (36).

The inner bottom of the casing (21) forms an oil receiver for lubricating oil. A lower end part of the shaft (33) is immersed in the lubricating oil in the oil receiver. Although not shown, the lower end part of the shaft (33) is provided with a centrifugal oil pump. The lubricating oil passes through a lubrication passage (53) inside the shaft (33) so as to be supplied to the areas where the low-stage side compression mechanism (40*a*) and the high-stage side compression mechanism (40*b*) slide.

The low-stage side compression mechanism (40*a*) and the high-stage side compression mechanism (40*b*) are placed one above the other below the electric motor (25). More particularly, in a part of an interior space of the casing (21) below the electric motor (25), a front head (44), a middle plate (46), and a rear head (45) are spaced in top-to-bottom order. The low-stage side compression mechanism (40*a*) is disposed between the rear head (45) and the middle plate (46) while the high-stage side compression mechanism (40*b*) is disposed between the middle plate (46) and the front head (44).

The shaft (33) passes through middle parts of the front head (44), middle plate (46) and rear head (45). The first eccentric shaft (35) is located between the rear head (45) and the middle plate (46) while the second eccentric shaft (36) is located between the middle plate (46) and the front head (44). The front head (44), the middle plate (46) and the rear head (45) form end plates, and their opposed surfaces form flat surfaces.

The low-stage side compression mechanism (40*a*) and the high-stage side compression mechanism (40*b*) have substantially the same basic construction and are both formed of so-called rolling piston rotary compressors.

Figure 3:
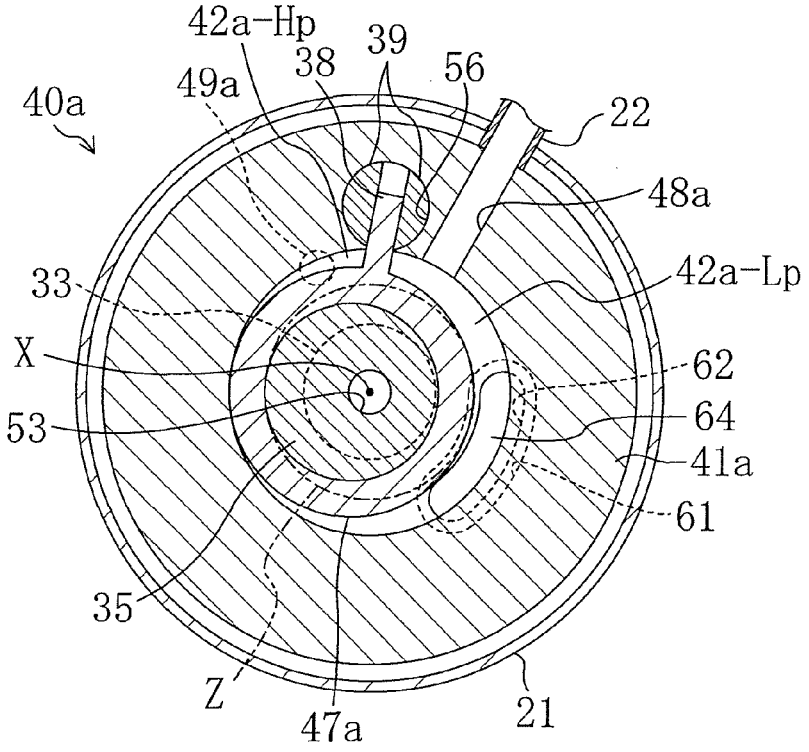
FIG. 3 is a lateral cross-sectional view showing the construction of a low-stage side compression mechanism of the two-stage compressor.

As shown in FIGS. 1 and 3, the low-stage side compression mechanism (40*a*) includes the rear head (45), the middle plate (46), a low-stage side cylinder (41*a*), a low-stage side piston (47*a*) contained in the low-stage side cylinder (41*a*), a blade (38) disposed on the low-stage side piston (47*a*), and bushes (39, 39) for supporting the blade (38). The low-stage side compression mechanism (40*a*) forms a first compression mechanism.

The low-stage side cylinder (41*a*) is a schematically cylindrical member. While the upper surface of the low-stage side cylinder (41*a*) abuts against the lower surface of the middle plate (46), the lower surface of the low-stage side cylinder (41*a*) abuts against the upper surface of the rear head (45). The lower surface of the middle plate (46) and the upper surface of the rear head (45) both form flat surfaces. The low-stage side cylinder (41*a*) forms a fixed member.

The low-stage side piston (47*a*) is a schematically cylindrical member and contained in the low-stage side cylinder (41*a*) while being rotatably fitted onto the first eccentric shaft (35). While a part of the outer circumferential surface of the low-stage side piston (47*a*) abuts against a part of the inner circumferential surface of the low-stage side cylinder (41*a*), the upper and lower surfaces of the low-stage side piston (47*a*) abut against the lower surface of the middle plate (46) and the upper surface of the rear head (45), respectively. The middle plate (46), the rear head (45), the low-stage side cylinder (41*a*), and the low-stage side piston (47*a*) define a low-stage side cylinder chamber (42*a*). The low-stage side piston (47*a*) and the low-stage side cylinder chamber (42*a*) form a movable member and a compression chamber, respectively.

As shown in FIG. 3, the low-stage side cylinder (41*a*) is provided with a cylindrical bush hole (56) extending along the rotational axis (X). A part of the circumferential surface of the cylindrical bush hole (56) is longitudinally opened to the low-stage side cylinder chamber (42*a*). A pair of swing bushes (39, 39) is rotatably disposed in the bush hole (56). The pair of swing bushes (39, 39) is shaped such that a cylinder is divided by a plane passing the center axis of the cylinder. The circular outer circumferential surfaces of the swing bushes (39, 39) are in sliding contact with the inner circumferential surface of the bush hole (56).

The low-stage side piston (47*a*) is formed continuously with the blade (38) radially extending from the lateral circumferential surface of the piston (47*a*). The blade (38) is supported while being sandwiched between the pair of swing bushes (39, 39). More particularly, the low-stage side piston (47*a*) is supported rotatably about the center axis of the bush hole (56) by the blade (38) and the pair of swing bushes (39, 39) while being supported reciprocatably in between the surfaces of the swing bushes (39, 39) obtained by dividing the cylinder in the above-mentioned manner. This blade (38) sections the low-stage side cylinder chamber (42*a*) into a low-pressure chamber (42*a*-Lp) at the low pressure side and a high-pressure chamber (42*a*-Hp) at the high pressure side.

The low-stage side cylinder (41*a*) is formed with a low-stage side suction passage (48*a*). The downstream end of the low-stage side suction passage (48*a*) is opened to the low-pressure chamber (42*a*-Lp) of the low-stage side cylinder chamber (42*a*) near the swing bushes (39, 39) to form a suction port. The suction pipe (22) of the refrigerant circuit (11) is coupled to the upstream end of the low-stage side suction passage (48*a*). Low-pressure gas refrigerant is supplied through the suction pipe (22) to the low-stage side compression mechanism (40*a*).

The inside of the middle plate (46) is formed with an intermediate-pressure space (50). Furthermore, the middle plate (46) is formed with a low-stage side discharge passage (49*a*). While the upstream end of the low-stage side discharge passage (49*a*) is opened to the high-pressure chamber (42*a*-Hp) of the low-stage side cylinder chamber (42*a*) near the swing bushes (39, 39) to form a discharge port, the downstream end of the low-stage side discharge passage (49*a*) communicates with the intermediate-pressure space (50). Although not shown, the low-stage side discharge passage (49*a*) is provided with a discharge valve for opening the discharge port when the pressure of the high-pressure chamber (42*a*-Hp) reaches a predetermined discharge pressure. The injection pipe (24) is coupled to the middle plate (46) to communicate with the intermediate-pressure space (50). More particularly, intermediate-pressure gas refrigerant discharged from the low-stage side compression mechanism (40*a*) to the intermediate-pressure space (50) and intermediate-pressure gas refrigerant supplied through the injection pipe (24) to the intermediate-pressure space (50) allow the pressure atmosphere of the intermediate-pressure space (50) to be an intermediate-pressure atmosphere.

The low-stage side piston (47*a*) eccentrically rotates about the rotational axis (X) while a part of its outer circumferential surface is in contact with a part of the inner circumferential surface of the low-stage side cylinder (41*a*). In this manner, the volume of the low-stage side cylinder chamber (42*a*) is changed, thereby compressing refrigerant.

The high-stage side compression mechanism (40*b*) includes the front head (44), the middle plate (46), a high-stage side cylinder (41*b*), a high-stage side piston (47*b*) contained in the high-stage side cylinder (41*b*), a blade (not shown) disposed on the high-stage side piston (47*b*), and bushes (not shown) for supporting the blade. The high-stage side compression mechanism (40*b*) forms a second compression mechanism. The high-stage side compression mechanism (40*b*) has basically the same construction as the low-stage side compression mechanism (40*a*). Components of the high-stage side compression mechanism (40*b*) corresponding to those of the low-stage side compression mechanism (40*a*) are represented by changing the alphabetical character "a" in the reference characters indicating the components of the low-stage side compression mechanism (40*a*) to "b".

While the top surface of the high-stage side cylinder (41*b*) abuts against the front head (44), the bottom surface thereof abuts against the middle plate (46). The high-stage side piston (47*b*) is contained in the high-stage side cylinder (41*b*) in the following manner: While the high-stage side piston (47*b*) is rotatably fitted onto the second eccentric shaft (36), a part of the outer circumferential surface of the high-stage side piston (47*b*) is in contact with a part of the inner circumferential surface of the high-stage side cylinder (41*b*). The front head (44), the middle plate (46), the high-stage side cylinder (41*b*), and the high-stage side piston (47*b*) define a high-stage side cylinder chamber (42*b*). Although not shown, like the low-stage side piston (47*a*), the high-stage side piston (47*b*) is supported while the blade disposed on the high-stage side piston (47*b*) is sandwiched between swing bushes.

The high-stage side cylinder (41*b*) is formed with a high-stage side suction passage (48*b*). The downstream end of the high-stage side suction passage (48*b*) is opened to a low-pressure chamber (not shown) of the high-stage side cylinder chamber (42*b*) near the swing bushes to form a suction port. A communication channel (57) that is opened to the intermediate-pressure space (50) passes through an upper part of the middle plate (46). The downstream end of the communication channel (57) communicates with the upstream end of the high-stage side suction passage (48*b*). More particularly, the low-pressure chamber of the high-stage side cylinder chamber (42*b*) communicates through the high-stage side suction passage (48*b*) and the communication channel (57) with the intermediate-pressure space (50) of the middle plate (46).

The front head (44) is formed with a high-stage side discharge passage (49*b*). While the upstream end of the high-stage side discharge passage (49*b*) is opened to a high-pressure chamber (not shown) of the high-stage side cylinder chamber (42*b*) near the swing bushes to form a discharge port, the downstream end of the high-stage side discharge passage (49*b*) is opened in the top surface of the front head (44). More particularly, refrigerant compressed by the high-stage side compression mechanism (40*b*) is discharged through the high-stage side discharge passage (49*b*) to the inside of the casing (21). A muffler (58) is disposed on the front head (44) to cover the high-stage side discharge passage (49*b*) of the high-stage side compression mechanism (40*b*).

The low-stage side cylinder (41*a*) and the high-stage side cylinder (41*b*) have the same inside diameter. The low-stage side piston (47*a*) and the high-stage side piston (47*b*) have the same outside diameter. In addition, the low-stage side cylinder (41*a*) and low-stage side piston (47*a*) are higher than the high-stage side cylinder (41*b*) and the high-stage side piston (47*b*). In view of the above, the maximum volume of the low-stage side cylinder chamber (42*a*) (i.e., the sum of the volumes of the high-pressure and low-pressure chambers or the volume of a cylinder chamber at the time when the containment of refrigerant in the cylinder chamber is completed) is greater than that of the high-stage side cylinder chamber (42*b*).

Next, a bypass passage formed in the low-stage side compression mechanism (40*a*) and an opening/closing mechanism for the bypass passage will be described.

A large-diameter valve-containing hole (61) is bored in the rear head (45) to extend from the lower surface of the rear head (45) to the vicinity of the upper surface thereof. A small-diameter bypass hole (62) is bored to extend from the ceiling of the valve-containing hole (61) to the upper surface of the rear head (45). The valve-containing hole (61) and the bypass hole (62) are coaxially formed. As shown in FIG. 3, the cross sections of the valve-containing hole (61) and bypass hole (62) form an arched shape curving along a circumferential direction about the rotational axis (X). The bypass hole (62) is formed across the inner circumferential edge of the low-stage side cylinder (41*a*) while extending along the inner circumferential edge. The valve-containing hole (61) and the bypass hole (62) are formed in a region of the low-stage side cylinder chamber (42*a*) near the low-stage side suction passage (48*a*). The lower end of the valve-containing hole (61) is sealed by a lid (63).

Figure 4A:
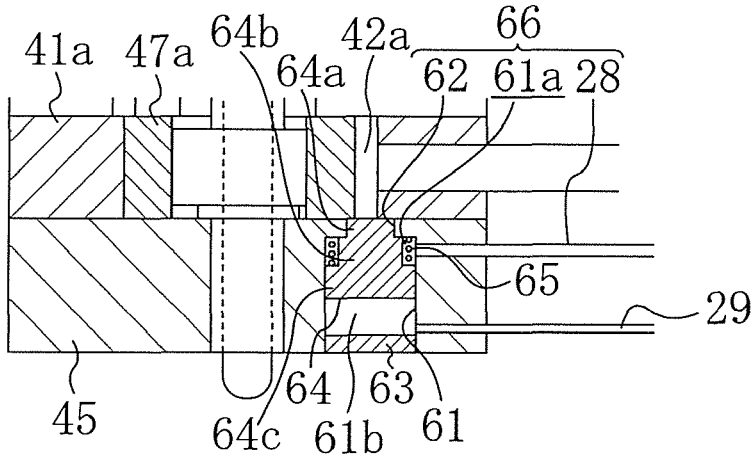
FIG. 4 are enlarged longitudinal cross-sectional views of a bypass passage.
Figure 4B:
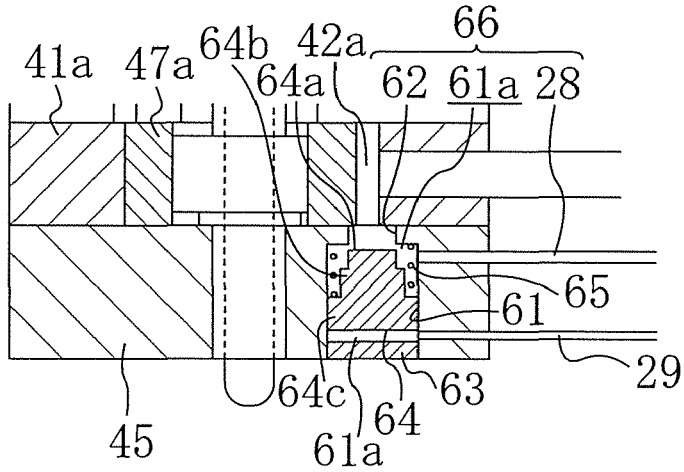

A valve (64) for opening/closing the bypass hole (62) and a spring (65) are contained in the valve-containing hole (61). The valve (64) is a columnar member and has an arched cross section like the valve-containing hole (61) and the bypass hole (62). As shown in FIG. 4(*a*), the outer shape of the valve (64) is widened downwardly in two stages. In other words, the valve (64) has an upper small-shape portion (64*a*), an intermediate middle-shape portion (64*b*), and a lower large-shape portion (64*c*). The small-shape portion (64*a*), middle-shape portion (64*b*) and large-shape portion (64*c*) are coaxially formed. While the outer circumferential shape of the small-shape portion (64*a*) generally coincides with the inner circumferential shape of the bypass hole (62), the outer circumferential shape of the large-shape portion (64*c*) generally coincides with the inner circumferential shape of the valve-containing hole (61). The small-shape portion (64*a*) and the large-shape portion (64*c*) slide while being engaged in the bypass hole (62) and the valve-containing hole (61), respectively. The large-shape portion (64*c*) sections the valve-containing hole (61) into an upper space (61*a*) and a lower space (61*b*).

The outer circumferential shape of the middle-shape portion (64*b*) is smaller than the inner circumferential shape of the valve-containing hole (61). The spring (65) is disposed around the middle-shape portion (64*b*). The spring (65) abuts at one end thereof against the top surface of the large-shape portion (64*c*) in the upper space (61*a*) while abutting at the other end thereof against the ceiling of the valve-containing hole (61). When the spring (65) has a natural length, the valve (64) is pushed down to the position in which the small-shape portion (64*a*) escapes from the bypass hole (62).

The distal end surface of the small-shape portion (64*a*) is flat. When the valve (64) is contained in the valve-containing hole (61), the distal end surface of the small-shape portion (64*a*) is formed in parallel to the top surface of the rear head (45). The height of the small-shape portion (64*a*) generally coincides with or is at least not greater than the depth of the bypass hole (62). More particularly, when the middle-shape portion (64*b*) abuts against the ceiling of the valve-containing hole (61), the small-shape portion (64*a*) of the valve (64) is inserted into the bypass hole (62) to the maximum. In this state, the distal end surface of the small-shape portion (64*a*) is flush with or slightly below the top surface of the rear head (45). Consequently, the distal end of the small-shape portion (64*a*) does not protrude into the low-stage side cylinder chamber (42*a*).

The bypass pipe (28) is coupled to the rear head (45) so as to be opened to the upper space (61*a*). The inlet pipe (29) is also coupled to the rear head (45) so as to be opened to the lower space (61*b*). More particularly, the three-way selector valve (13) switches between the state in which high-pressure refrigerant flowing through the discharge pipe (23) is brought into the lower space (61*b*) of the valve-containing hole (61) and the state in which low-pressure refrigerant flowing through the suction pipe (22) is brought thereinto.

The bypass hole (62), the upper space (61*a*) of the valve-containing hole (61), and the bypass pipe (28) form a bypass passage (66). The bypass hole (62) forms the upstream end of the bypass passage (66). Furthermore, the valve (64), the spring (65), the inlet pipe (29), and the three-way selector valve (13) form an opening/closing mechanism.

More specifically, if the three-way selector valve (13) is set as shown by the solid line in FIG. 2, high-pressure refrigerant flowing through the discharge pipe (23) is brought through the inlet pipe (29) into the lower space (61*b*). Thus, the brought high-pressure refrigerant allows the valve (64) to move upwardly while the spring (65) is contracted.

Then, as shown in FIG. 4(*a*), the small-shape portion (64*a*) of the valve (64) is inserted into the bypass hole (62), resulting in the closed bypass passage (66). If the three-way selector valve (13) is set as shown by the broken line in FIG. 2, low-pressure refrigerant flowing through the suction pipe (22) is brought through the inlet pipe (29) into the lower space (61*b*). This allows the valve (64) to move downwardly while the spring (65) extends. Then, as shown in FIG. 4(*b*), the small-shape portion (64*a*) of the valve (64) is drawn from the bypass hole (62), resulting in the opened bypass passage (66). When the bypass passage (66) is thus opened, the low-stage side cylinder chamber (42*a*) communicates with the suction pipe (22).

—Operational Behavior—

A description will be given of the behaviors of the air conditioner (10). Here, the description will be given first of the behavior of the air conditioner (10) in cooling operation, then of the behavior thereof in heating operation and then the behavior of the two-stage compressor (20).

<Cooling Operation>

In cooling operation, the four-way selector valve (12) is switched to the position shown by the solid line in FIG. 2. When in this state the electric motor (25) of the two-stage compressor (20) is energized, refrigerant circulates through the refrigerant circuit (11) so that a vapor compression refrigeration cycle is performed.

Refrigerant compressed by the two-stage compressor (20) is discharged from the discharge pipe (23), passes through the four-way selector valve (12) and is delivered to the outdoor heat exchanger (14), thereby releasing heat to the outdoor air. High-pressure refrigerant having released heat in the outdoor heat exchanger (14) is decompressed by the second expansion valve (17) to turn into intermediate-pressure refrigerant. The intermediate-pressure refrigerant flows into the gas-liquid separator (18). The intermediate-pressure refrigerant having flowed into the gas-liquid separator (18) is separated into intermediate-pressure gas refrigerant and intermediate-pressure liquid refrigerant. Among them, the intermediate-pressure liquid refrigerant having flowed out from the bottom of the gas-liquid separator (18) is decompressed by the first expansion valve (16) to turn into low-pressure liquid refrigerant. The low-pressure liquid refrigerant flows into the indoor heat exchanger (15). In the indoor heat exchanger (15), the refrigerant having flowed thereinto absorbs heat from the indoor air and evaporates, thereby cooling the indoor air. The low-pressure refrigerant having flowed out from the indoor heat exchanger (15) passes through the four-way selector valve (12) and an accumulator (19) in this order and is sucked into the two-stage compressor (20). The two-stage compressor (20) again compresses the sucked refrigerant and discharges it.

In the cooling operation, if the electromagnetic valve (31) is set to open, intermediate-pressure gas refrigerant in the gas-liquid separator (18) is brought into the intermediate-pressure space (50) of the two-stage compressor (20) by the injection pipe (24). The refrigerant brought into the intermediate-pressure space (50) is compressed in the high-stage side compression mechanism (40*b*) together with refrigerant discharged from the low-stage side compression mechanism (40*a*). The details of the behavior of the two-stage compressor (20) will be described below.

<Heating Operation>

In heating operation, the four-way selector valve (12) is switched to the position shown by the broken line in FIG. 2. When in this state the electric motor (25) of the two-stage compressor (20) is energized, refrigerant circulates through the refrigerant circuit (11) so that a vapor compression refrigeration cycle is performed. Refrigerant compressed by the two-stage compressor (20) is discharged from the discharge pipe (23), passes through the four-way selector valve (12) and flows into the indoor heat exchanger (15). In the indoor heat exchanger (15), the refrigerant having flowed thereinto releases heat to the indoor air, thereby heating the indoor air. The refrigerant having released heat in the indoor heat exchanger (15) is decompressed by the first expansion valve (16) to turn into intermediate-pressure refrigerant. The intermediate-pressure refrigerant flows into the gas-liquid separator (18). The intermediate-pressure refrigerant having flowed into the gas-liquid separator (18) is separated into intermediate-pressure gas refrigerant and intermediate-pressure liquid refrigerant. Among them, the intermediate-pressure liquid refrigerant having flowed out from the bottom of the gas-liquid separator (18) is decompressed by the second expansion valve (17) to turn into low-pressure liquid refrigerant. The low-pressure liquid refrigerant decompressed by the second expansion valve (17) is delivered to the outdoor heat exchanger (14) to absorb heat from the outdoor air and evaporate. The low-pressure refrigerant having flowed out from the outdoor heat exchanger (14) passes through the four-way selector valve (12) and the accumulator (19) in this order and is sucked into the two-stage compressor (20). The two-stage compressor (20) again compresses the sucked refrigerant and discharges it.

Also in the heating operation, if the electromagnetic valve (31) is set to open, intermediate-pressure gas refrigerant in the gas-liquid separator (18) is brought into the intermediate-pressure space (50). The refrigerant brought into the intermediate-pressure space (50) is compressed in the high-stage side compression mechanism (40*b*) together with refrigerant discharged from the low-stage side compression mechanism (40*a*).

<Behavior of Two-Stage Compressor>

The behavior of the two-stage compressor (20) will be described with reference to FIG. 5. For the two-stage compressor (20), the energization of the electric motor (25) allows power generated by the electric motor (25) to rotate the shaft (33). The low-stage side and high-stage side pistons (47*a*, 47*b*) slidably circumscribing the first and second eccentric shafts (35, 36) disposed on the shaft (33) eccentrically rotate in the low-stage side and high-stage side cylinders (41*a*, 41*b*), respectively. In this way, refrigerant is compressed by the low-stage side compression mechanism (40*a*) and the high-stage side compression mechanism (40*b*). Hereinafter, a description will be given of the behavior of the two-stage compressor (20) under each of the situations in which the bypass passage (66) is closed and in which it is opened. The compression behaviors of the low-stage side compression mechanism (40*a*) and the high-stage side compression mechanism (40*b*) are basically similar. Therefore, the low-stage side compression mechanism (40*a*) will be principally described.

Initially, a description will be given of the behavior of the two-stage compressor (20) under the situation in which the bypass passage (66) is closed. As previously described, if the three-way selector valve (13) is set to the position shown by the solid line in FIG. 2, the bypass passage (66) is closed.

Suppose herein that the eccentric rotation angle of the low-stage side piston (47*a*) is zero degree when the swing center of the swing bushes (39, 39) and the axial center (Y) of the low-stage side piston (47*a*) (the axial center of the first eccentric shaft (35)) are aligned on a straight line radially extending from the rotational axis (X) of the shaft (33) in a plan view (or, when the axial center (Y) of the low-stage side piston (47*a*) is located on a line segment connecting the rotational axis (X) to the swing bushes (39, 39)).

When the shaft (33) rotates so that the eccentric rotation angle of the low-stage side piston (47*a*) becomes slightly larger than zero degree and thus the location at which the low-stage side piston (47*a*) abuts against the low-stage side cylinder (41*a*) passes an opening of the low-stage side suction passage (48*a*), the low-pressure chamber (42*a*-Lp) is formed in the low-stage side cylinder chamber (42*a*) so that refrigerant starts flowing through the low-stage side suction passage (48*a*) into the low-pressure chamber (42*a*-Lp). As the eccentric rotation angle of the low-stage side piston (47*a*) is increased to 90°, to 180°, then to 270°, the volume of the low-pressure chamber (42*a*-Lp) increases, and refrigerant flows into the low-pressure chamber (42*a*-Lp). The inflow of the refrigerant continues until the eccentric rotation angle becomes 360 degrees.

Thereafter, when the shaft (33) rotates slightly from the position in which the eccentric rotation angle of the low-stage side piston (47*a*) is 360 degrees (i.e., zero degree), the location at which the low-stage side piston (47*a*) abuts against the low-stage side cylinder (41*a*) passes the opening of the low-stage side suction passage (48*a*). For the low-stage side compression mechanism (40*a*), the containment of the refrigerant in the low-pressure chamber (42*a*-Lp) is completed at the time when this abutment location has passed the opening of the low-stage side suction passage (48*a*). When the shaft (33) further rotates from this state, the low-pressure chamber (42*a*-Lp) turns into the high-pressure chamber (42*a*-Hp). In this high-pressure chamber (42*a*-Hp), compression of refrigerant is started. As the eccentric rotation angle of the low-stage side piston (47*a*) is increased to 90°, to 180°, then to 270°, the volume of the high-pressure chamber (42*a*-Hp) decreases, resulting in compressed refrigerant. When the pressure of refrigerant in the high-pressure chamber (42*a*-Hp) is above the pressure of refrigerant in the intermediate-pressure space (50), the discharge valve is opened so that refrigerant is discharged from the discharge passage (49*a*) to the intermediate-pressure space (50). The discharge of the refrigerant continues until the eccentric rotation angle of the shaft (33) becomes 360 degrees.

For the high-stage side compression mechanism (40*b*), like the low-stage side compression mechanism (40*a*), refrigerant is sucked into the high-stage side cylinder chamber (42*b*) along with the eccentric rotation of the high-stage side piston (47*b*), and the sucked refrigerant is compressed. When the pressure of the refrigerant in the high-stage side cylinder chamber (42*b*) is above the pressure of refrigerant in an interior space of the casing (21), the discharge valve is opened so that refrigerant is discharged through the discharge passage (49*b*) to the interior space of the casing (21). The refrigerant discharged to the interior space of the casing (21) is discharged through the discharge pipe (23) to the refrigerant circuit (11). Since the first eccentric shaft (35) and the second eccentric shaft (36) are eccentric on opposite sides of the rotational axis (X), the low-stage side piston (47*a*) and the high-stage side piston (47*b*) eccentrically rotate with their phases always shifted by 180 degrees relative to each other.

Next, a description will be given of the behavior of the two-stage compressor (20) when the bypass passage (66) is opened. As previously described, if the three-way selector valve (13) is set to the position shown by the broken line in FIG. 2, the bypass passage (66) is opened.

When the shaft (33) rotates slightly from the position in which the eccentric rotation angle of the low-stage side piston (47*a*) is zero degree and thus the location at which the low-stage side piston (47*a*) abuts against the low-stage side cylinder (41*a*) passes the opening of the low-stage side suction passage (48*a*), the low-pressure chamber (42*a*-Lp) is formed in the low-stage side cylinder chamber (42*a*) so that refrigerant starts flowing through the low-stage side suction passage (48*a*) into the low-pressure chamber (42*a*-Lp) as described above.

Then, the eccentric rotation angle of the low-stage side piston (47*a*) again becomes zero degree. The low-stage side piston (47*a*) eccentrically rotates from this position, and thus the location at which the low-stage side piston (47*a*) abuts against the low-stage side cylinder (41*a*) passes the opening of the low-stage side suction passage (48*a*). At this time, the suction of refrigerant into the low-pressure chamber (42*a*-Lp) is completed, and the low-pressure chamber (42*a*-Lp) turns into the high-pressure chamber (42*a*-Hp).

Since in this state the bypass passage (66) is opened, refrigerant is not compressed in the high-pressure chamber (42*a*-Hp) even with further eccentric rotation of the low-stage side piston (47*a*). Thus, the refrigerant in the high-pressure chamber (42*a*-Hp) is ejected through the bypass hole (62) and the bypass passage (66) to the suction pipe (22). The ejection of the refrigerant continues until the low-stage side piston (47*a*) blocks the bypass hole (62), i.e., until the eccentric rotation angle of the low-stage side piston (47*a*) becomes approximately 135 degrees. At the time when the low-stage side piston (47*a*) has blocked the bypass hole (62), the ejection of the refrigerant terminates. Simultaneously, the containment of refrigerant in the high-pressure chamber (42*a*-Hp) is completed. Then, when the shaft (33) further rotates from this state, compression of refrigerant in the high-pressure chamber (42*a*-Hp) starts. When the pressure of the refrigerant in the high-pressure chamber (42*a*-Hp) is above the pressure of refrigerant in the intermediate-pressure space (50), the discharge valve is opened so that the refrigerant is discharged through the discharge passage (49*a*) to the intermediate-pressure space (50). The discharge of the refrigerant continues until the eccentric rotation angle of the low-stage side piston (47*a*) reaches 360 degrees.

A process from the inflow of refrigerant to the compression thereof in the high-stage side compression mechanism (40*b*) is similar to that when the bypass passage (66) is closed, and thus a description of the process is omitted.

As previously described, if the bypass passage (66) is closed, the containment of refrigerant in the low-stage side compression mechanism (40*a*) is completed at the time when the location at which the low-stage side piston (47*a*) abuts against the low-stage side cylinder (41*a*) passes the opening of the low-stage side suction passage (48*a*). On the other hand, if the bypass passage (66) is opened, the containment of refrigerant in the low-stage side compression mechanism (40*a*) is completed at the time when the low-stage side piston (47*a*) has blocked the bypass hole (62). In the above-mentioned manner, for the two-stage compressor (20), the opening/closing of the bypass passage (66) can change the containment volume of the low-stage side compression mechanism (40*a*). In view of the above, the ratio between the suction volume of the low-stage side compression mechanism (40*a*) (i.e., the maximum volume of the low-stage side cylinder chamber (42*a*)) and that of the high-stage side compression mechanism (40*b*) (i.e., the maximum volume of the high-stage side cylinder chamber (42*b*)) varies.

A description will be given of, for example, a two-stage compressor (20) designed such that when the bypass passage (66) is closed, the volume ratio K of the suction volume V1 of the low-stage side compression mechanism (40*a*) to the suction volume V2 of the high-stage side compression mechanism (40*b*) (=V2/V1) becomes 0.7. For this two-stage compressor (20), when the bypass passage (66) is closed on the operating condition in which the pressure difference between the sucked refrigerant and discharged refrigerant is relatively large, a refrigerant compression stroke is performed in a balanced manner between the low-stage side compression mechanism (40*a*) and the high-stage side compression mechanism (40*b*). For this two-stage compressor (20), on the operating condition in which the pressure difference is small, the bypass passage (66) is opened, thereby reducing the containment volume of the low-stage side compression mechanism (40*a*). In this way, the volume ratio K is increased so that the refrigerant compression ratios of the compression mechanisms (40*a*, 40*b*) are averaged. As a result, the balance of the refrigerant compression stroke between the low-stage side compression mechanism (40*a*) and the high-stage side compression mechanism (40*b*) is adjusted.

—Advantages of Embodiment 1—

In view of the above, according to the first embodiment, the bypass hole (62) forms an arched shape curving along a circumferential direction about the rotational axis (X), thereby possibly increasing the area of the opening of the bypass hole (62). As a result, when part of refrigerant in the low-stage side cylinder chamber (42*a*) is returned to the suction pipe (22) with the bypass passage (66) opened, a sufficient refrigerant outflow can be ensured.

Figures 5A, 5B, 5C, 5D, 5E, 5F, 5G, 5H:
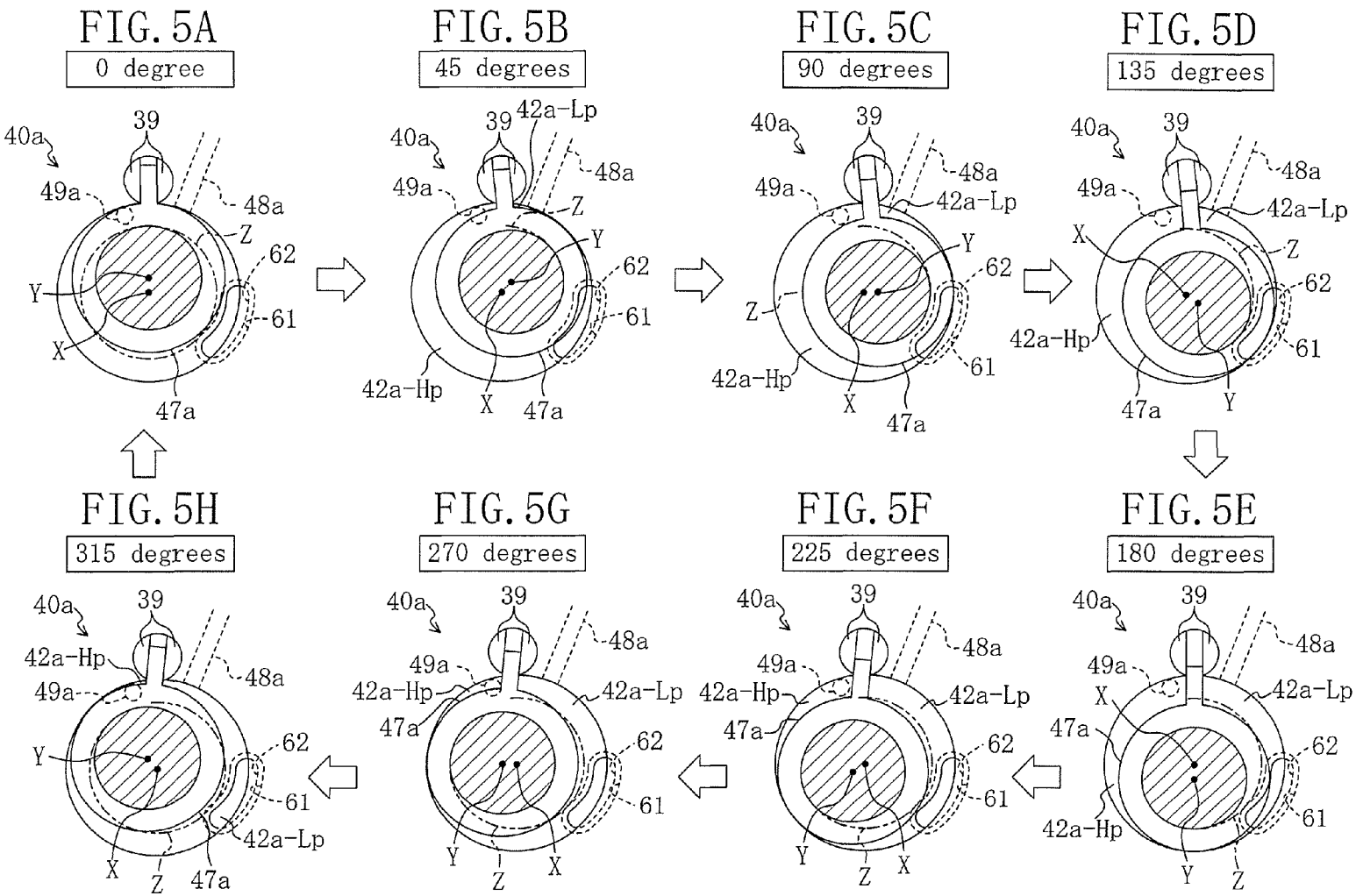
FIG. 5 are diagrammatical representations showing actions of the low-stage side compression mechanism.

More particularly, the inner circumferential edge of the low-stage side piston (47*a*), i.e., an interior space of the low-stage side piston (47*a*), describes the trajectory (Z) shown by alternate long and short dash line in FIG. 5 while the low-stage side piston (47*a*) eccentrically rotates. The trajectory (Z) forms a circle whose center is the rotational axis (X) and whose radius is equal to the sum of the eccentricity of the first eccentric shaft (35) from the rotational axis (X) and the inside diameter (radius) of the low-stage side piston (47*a*). When the bypass hole (62) is formed within this trajectory (Z), the interior space of the eccentrically rotating low-stage side piston (47*a*) and the bypass hole (62) overlap one another, and therefore high-pressure and high-temperature lubricating oil that has been supplied to the interior space of the low-stage side piston (47*a*) may leak through the bypass hole (62) to the suction pipe (22). For this reason, the bypass hole (62) needs to be opened outside the trajectory (Z). In other words, the bypass hole (62) is preferably opened in an annular region of the top surface of the rear head (45) located outside the trajectory (Z) and within the low-stage side cylinder (41*a*).

Here, when a bypass hole has a circular cross section, despite the fact that the area of the opening of the bypass hole should be increased, the diameter of the bypass hole cannot be increased very much in order to open the bypass hole in the annular region. When the area of the opening of the bypass hole is small, the refrigerant outflow cannot be sufficiently ensured even with the bypass passage (66) opened. As a result, when the low-stage side piston (47*a*) has blocked the bypass hole and the containment of refrigerant in the high-pressure chamber (42*a*-Hp) has been completed, compression of the refrigerant in the high-pressure chamber (42*a*-Hp) progresses to some extent. This state is apparently similar to the state in which before the low-stage side piston (47*a*) blocks the bypass hole, the containment of the refrigerant in the high-pressure chamber (42*a*-Hp) is completed and then the refrigerant is compressed to some extent. In other words, although the position of the bypass hole has been designed such that the volume of the high-pressure chamber (42*a*-Hp) becomes a desired suction volume V1 at the time when the low-stage side piston (47*a*) has blocked the bypass hole, the actual suction volume V1 becomes greater than the designed value.

To deal with the above situation, in the first embodiment, the cross section of the bypass hole (62) forms an arched shape extending while curving along a circumferential direction about the rotational axis (X). This allows the formation of a bypass hole (62) with a large-area opening even in the annular region having a limited width extending radially from the rotational axis (X). As a result, when the bypass passage (66) is opened, the refrigerant outflow can be sufficiently ensured. This keeps the refrigerant from being compressed in the high-pressure chamber (42*a*-Hp) while the refrigerant is ejected. Therefore, the actual suction volume V1 can be brought closer to a desired value. The entire cross section of the bypass hole (62) does not need to be formed in the annular region. As shown in FIG. 3, even if a part of the cross section thereof is covered with the low-stage side cylinder (41*a*), the remaining part of the cross section only needs to be formed in the annular region.

As previously described, the bypass hole (62) is formed in a part of the top surface of the rear head (45) outside the trajectory (Z). Even with a large bypass hole (62), the bypass hole (62) formed as described above can prevent high-pressure and high-temperature lubricating oil from leaking through the interior space of the low-stage side piston (47*a*) and the bypass hole (62) to the suction pipe (22) when the low-stage side piston (47*a*) eccentrically rotates. This prevention can prevent the volumetric efficiency from being reduced due to the refrigerant heated by the lubricating oil.

Furthermore, the upstream end of the bypass passage (66), i.e., a bypass hole (62), is opened in the top surface of the rear head (45) that forms a flat surface, and a distal end surface of the valve (64) forms a flat surface, and is formed in parallel to the top surface of the rear head (45), thereby possibly reducing the dead volume between the top surface of the rear head (45) and the distal end surface of the valve (64) when the bypass passage (66) is closed. Since, with the bypass passage (66) closed, refrigerant left in the low-stage side compression mechanism (40*a*) without being discharged in compression thus mostly disappears, this can prevent provision of the bypass passage (66) from reducing the refrigerant compression efficiency of the low-stage side compression mechanism (40*a*). Since in this case the distal end surface of the valve (64) forms a flat surface, this can restrain the production cost of the valve (64) as compared with the case where the distal end surface of the valve (64) forms a curved surface curving along the inner circumferential surface of the low-stage side cylinder (61*a*).

When the bypass passage (66) is closed, the distal end surface of the valve (64) is preferably flush with the top surface of the rear head (45). This can eliminate the dead volume between the top surface of the rear head (45) and the distal end surface of the valve (64), resulting in further enhancement of the compression efficiency of the low-stage side compression mechanism (40*a*).

Moreover, also for the two-stage compressor (20) configured such that the rotational speed of the low-stage side compression mechanism (40*a*) is always equal to that of the high-stage side compression mechanism (40*b*), the provision of the bypass passage (66) allows the ratio between the suction volumes of the compression mechanisms (40*a*, 40*b*) to vary. Therefore, even if, for example, the pressure difference between refrigerant sucked into the two-stage compressor (20) and refrigerant discharged therefrom varies, the suction volume of the low-stage side compression mechanism (40*a*) or the high-stage side compression mechanism (40*b*) is adjusted depending on the variations, thereby averaging the refrigerant compression ratios of the compression mechanisms (40*a*, 40*b*). When the refrigerant compression ratios of the compression mechanisms (40*a*, 40*b*) are averaged, the difference between the fluctuating ranges of the compression torques required to compress refrigerant in the compression mechanisms (40*a*, 40*b*) is reduced. Consequently, fluctuations in the compression torques for the compression mechanisms (40*a*, 40*b*) are averaged, resulting in a reduction in the fluctuating range of the compression torque for the entire two-stage compressor (20). In view of the above, according to this embodiment, even if the operating conditions of the two-stage compressor (20) vary, the suction volume ratio between the low-stage side compression mechanism (40*a*) and the high-stage side compression mechanism (40*b*) is adjusted, thereby keeping vibrations of the two-stage compressor (20) at a low level.

Furthermore, in the first embodiment, the containment volume of the low-stage side compression mechanism (40*a*) is changed, thereby changing the amount of refrigerant supplied from the low-stage side compression mechanism (40*a*) to the high-stage side compression mechanism (40*b*). As a result, the amount of intermediate-pressure gas refrigerant brought through the injection pipe (24) into the high-stage side compression mechanism (40*b*) is adjusted.

For a conventional two-stage compressor, when the two-stage compressor is designed such that a refrigerant compression stroke is performed in a balanced manner between the low-stage side compression mechanism (40*a*) and the high-stage side compression mechanism (40*b*) under the operating condition in which the pressure difference between the sucked refrigerant and the discharged refrigerant is relatively large, a refrigerant compression stroke is mostly performed in the low-stage side compression mechanism (40*a*) under the operating condition in which the pressure difference is relatively small. Therefore, the pressure in the intermediate-pressure space (50) becomes relatively high. Thus, the amount of the intermediate-pressure refrigerant brought through the injection pipe (24) into the intermediate-pressure space (50) is reduced. This reduction might have hindered a predetermined economizer effect from being provided. More particularly, the amount of the intermediate-pressure refrigerant supplied to the high-stage side compression mechanism (40*b*) might have been reduced, thereby preventing the enthalpy of the refrigerant sucked into the high-stage side compression mechanism (40*b*) from being sufficiently reduced. This prevention might have hindered the power required to drive the high-stage side compression mechanism (40*b*) from being reduced. Furthermore, the enthalpy of refrigerant at the entrance of an evaporator (in cooling operation, the indoor heat exchanger (15) and in heating operation, the outdoor heat exchanger (14)) might also have been prevented from being sufficiently reduced.

In the first embodiment, also in the above-mentioned case, a reduction in the containment volume of the low-stage side compression mechanism (40*a*) decreases the amount of the refrigerant supplied from the low-stage side compression mechanism (40*a*) to the high-stage side compression mechanism (40*b*). This decrease can keep the amount of the intermediate-pressure gas refrigerant brought into the high-stage side compression mechanism (40*b*) from being reduced. In view of the above, a predetermined economizer effect is achieved, resulting in an increase in the operating efficiency of the two-stage compressor (20). Furthermore, the cooling and heating efficiencies of the air conditioner (10) are also increased.

Moreover, in the first embodiment, a reduction in the containment volume of the low-stage side compression mechanism (40*a*) can decrease the amount of refrigerant circulating through the refrigerant circuit (11) without lowering the rotational speed of the electric motor (25). In order to decrease the amount of refrigerant circulating through the refrigerant circuit (11), the rotational speed of the electric motor (25) has conventionally been lowered. In view of the above, unlike the conventional art, the amount of the circulating refrigerant can be reduced while the rotational speed of the electric motor (25) providing high efficiency is maintained.

—Modification—

The first embodiment may be configured as in the following modification.

Figure 6:
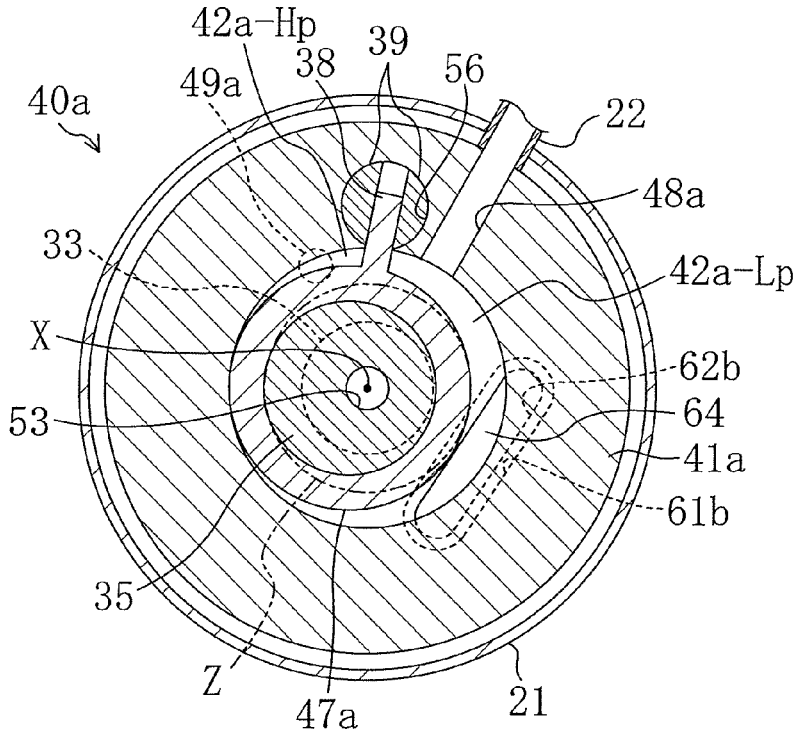
FIG. 6 is a lateral cross-sectional view showing the construction of a low-stage side compression mechanism according to a first modification of the first embodiment.

More particularly, as shown in FIG. 6, a bypass hole (62*b*) may have an elongated cross section. In this case, the bypass hole (62*b*) has an elongated cross section extending orthogonally to a radial direction from the rotational axis (X). In other words, the bypass hole (62*b*) extends along a tangential direction of the inner circumferential edge of the low-stage side cylinder (41*a*) and across the inner circumferential edge. The elongated cross section of the bypass hole (62*b*) as described above can also increase the area of the opening of the bypass hole (62*b*) as compared with the case where the bypass hole has a circular cross section. In this case, the valve-containing hole (61) and the valve (64) are also formed such that their cross sections become elongated like the bypass hole (62*b*).

Figure 7:
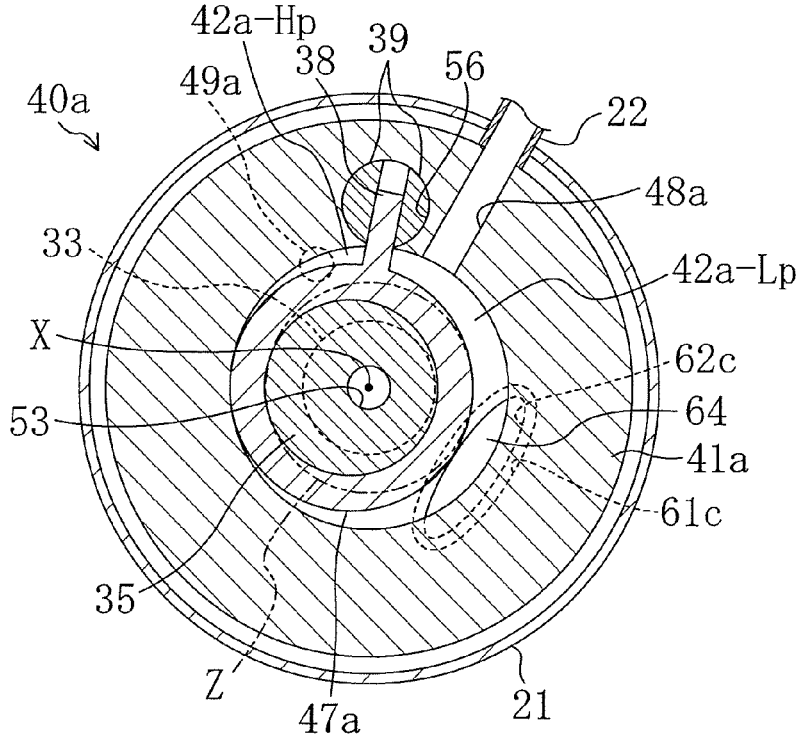
FIG. 7 is a lateral cross-sectional view showing the construction of a low-stage side compression mechanism according to a second modification of the first embodiment.

Alternatively, as shown in FIG. 7, a bypass hole (62*c*) may have an oval cross section. In this case, the bypass hole (62*c*) has an oval cross section whose major axis extends orthogonally to a radial direction from the rotational axis (X). In other words, the major axis of the bypass hole (62*c*) extends along a tangential direction of the inner circumferential edge of the low-stage side cylinder (41*a*) and across the inner circumferential edge. The oval cross section of the bypass hole (62*c*) as described above can also increase the area of the opening of the bypass hole (62*c*) as compared with the case where the bypass hole has a circular cross section. In this case, the valve-containing hole (61) and the valve (64) are also formed such that their cross sections become oval like the bypass hole (62*c*).

The bypass holes (62*b*, 62*c*) are preferably formed as close to the rotational axis (X) as possible, i.e., close to the trajectory (Z). This can possibly increase the areas of the openings of the bypass holes (62*b*, 62*c*).

<<Embodiment 2 of the Invention>>

Next, a second embodiment of the present invention will be described. Unlike the first embodiment, a two-stage compressor (220) according to the second embodiment is configured such that a bypass passage is formed in a high-stage side compression mechanism (240*b*) to change the containment volume of the high-stage side compression mechanism (240*b*). In other words, a low-stage side compression mechanism (240*a*) forms a second compression mechanism while the high-stage side compression mechanism (240*b*) forms a compression mechanism. The same components as in the first embodiment are denoted by the same reference characters, and description thereof is omitted.

Figure 8:
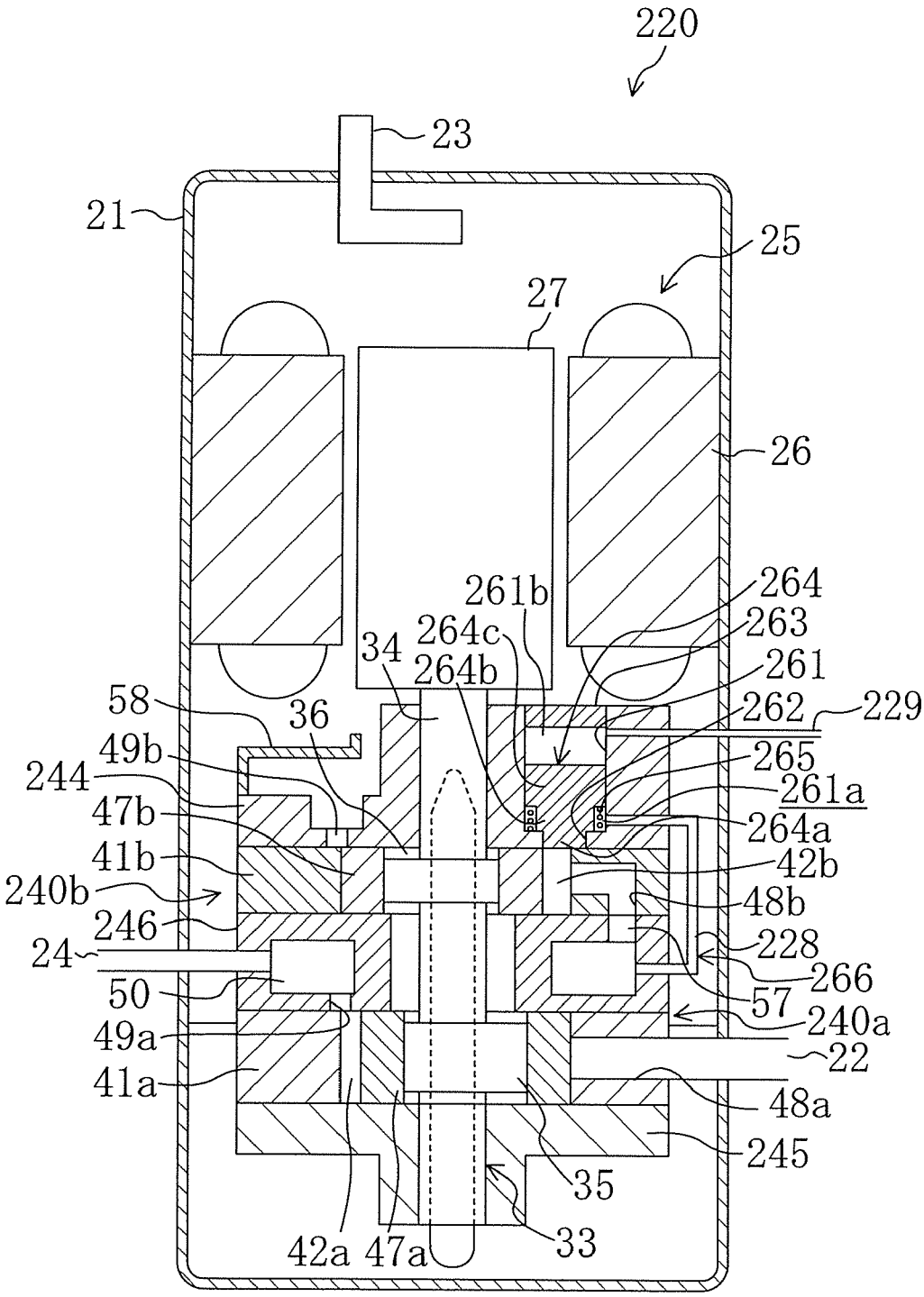
FIG. 8 is a longitudinal cross-sectional view of a two-stage compressor according to a second embodiment.

More specifically, as shown in FIG. 8, like the rear head (45) of the first embodiment, a large-diameter valve-containing hole (261) is bored in a front head (244) to extend from the top surface of the front head (244) to the vicinity of the bottom surface thereof. Meanwhile, a small-diameter bypass hole (262) is bored in the front head (244) to extend from the bottom of the valve-containing hole (261) to the bottom surface of the front head (244). The valve-containing hole (261) and the bypass hole (262) are coaxially formed. The upper end of the valve-containing hole (261) is sealed by a lid (263).

A valve (264) for opening/closing the bypass hole (262) and a spring (265) are contained in the valve-containing hole (261). The valve (264) is a columnar member whose outer shape is widened upwardly in two stages and has a lower small-shape portion (264*a*), an inteunediate middle-shape portion (264*b*) and an upper large-shape portion (264*c*). The small-shape portion (264*a*), middle-shape portion (264*b*) and large-shape portion (264*c*) are coaxially formed. While the outer circumferential shape of the small-shape portion (264*a*) generally coincides with the inner circumferential shape of the bypass hole (262), the outer circumferential shape of the large-shape portion (264*c*) generally coincides with the inner circumferential shape of the valve-containing hole (261). The small-shape portion (264*a*) and the large-shape portion (264*c*) slide while being engaged in the bypass hole (262) and the valve-containing hole (261), respectively. The large-shape portion (264*c*) sections the valve-containing hole (261) into a lower space (261*a*) and an upper space (261*b*).

The outer circumferential shape of the middle-shape portion (264*b*) is smaller than the inner circumferential shape of the valve-containing hole (261). A spring (265) is disposed around the middle-shape portion (264*b*). The spring (265) abuts at one end thereof against the bottom surface of the large-shape portion (264*c*) in the lower space (261*a*) while abutting at the other end thereof against the bottom of the valve-containing hole (261). When the spring (265) has a natural length, the valve (264) is pushed up to the position in which the small-shape portion (264*a*) escapes from the bypass hole (262).

The distal end surface of the small-shape portion (264*a*) is flat and formed in parallel to the top surface of the front head (244) when the valve (264) is contained in the valve-containing hole (261). The height of the small-shape portion (264*a*) generally coincides with or is at least not greater than the depth of the bypass hole (262). More particularly, when the middle-shape portion (264*b*) abuts against the bottom of the valve-containing hole (261), the small-shape portion (264*a*) of the valve (264) is inserted into the bypass hole (262) to the maximum. In this case, the distal end surface of the small-shape portion (264*a*) is flush with or slightly above the bottom surface of the front head (244). Consequently, the distal end of the small-shape portion (264*a*) does not protrude into the low-stage side cylinder chamber (42*a*).

The upstream end of a bypass pipe (228) is coupled to the front head (244) so as to be opened to the lower space (261*a*). The downstream end of an inlet pipe (229) is also coupled to the front head (244) so as to be opened to the upper space (261*b*). More particularly, a three-way selector valve (13) switches between the state in which high-pressure refrigerant flowing through a discharge pipe (23) is brought into the upper space (261*b*) of the valve-containing hole (261) and the state in which low-pressure refrigerant flowing through a suction pipe (22) is brought thereinto. The downstream end of the bypass pipe (228) is opened to the inside of an intermediate-pressure space (50) of a middle plate (246).

The bypass hole (262), the lower space (261*a*) of the valve-containing hole (261) and the bypass pipe (228) form a bypass passage (266). The bypass hole (262) forms the upstream end of the bypass passage (266). Furthermore, the valve (264), the spring (265), an inlet pipe (229), and the three-way selector valve (13) form an opening/closing mechanism.

The two-stage compressor (220) of the second embodiment is designed such that, for example, when the bypass passage (266) is closed, the volume ratio K of the containment volume V1 of the low-stage side compression mechanism (240*a*) to the containment volume V2 of the high-stage side compression mechanism (240*b*) (=V2/V1) becomes 0.85. For this two-stage compressor (220), when the bypass passage (266) is closed on the operating condition in which the pressure difference between the sucked refrigerant and discharged refrigerant is relatively small, a refrigerant compression stroke is performed in a balanced manner between the low-stage side compression mechanism (240*a*) and the high-stage side compression mechanism (240*b*). For this two-stage compressor (220), on the operating condition in which the pressure difference is large, the bypass passage (266) is opened, thereby reducing the containment volume of the high-stage side compression mechanism (240*b*). In this way, the volume ratio K is reduced so that the refrigerant compression ratios of the compression mechanisms (240*a*, 240*b*) are averaged. As a result, the balance of the refrigerant compression stroke between the low-stage side compression mechanism (240*a*) and the high-stage side compression mechanism (240*b*) is adjusted. Furthermore, the pressure in the intermediate-pressure space (50) is adjusted to a pressure value effectively providing a predetermined economizer effect.

While the high-stage side piston (47*b*) eccentrically rotates, the inner circumferential edge of the high-stage side piston (47*b*), i.e., an interior space of the high-stage side piston (47*b*), describes a trajectory similar to the trajectory (Z) of the low-stage side piston (47*a*) shown in FIG. 5. In other words, in order to prevent lubricating oil in the interior space of the high-stage side piston (47*b*) from leaking out into the bypass hole (262), the bypass hole (262) is preferably opened in an annular region of the front head (244) located outside the trajectory (Z) and within the high-stage side cylinder (41*b*). To cope with this, in the second embodiment, like the first embodiment, the cross section of the bypass hole (262) forms an arched shape extending circumferentially about the rotational axis (X). This allows the formation of a bypass hole (262) with a large-area opening even in the annular region having a limited width extending radially from the rotational axis (X).

<<Embodiment 3 of the Invention>>

Next, a third embodiment of the present invention will be described. Unlike the first embodiment, a two-stage compressor (320) of the third embodiment is configured such that a valve-containing hole (361) and a bypass hole (362) are formed in the sidewall of a low-stage side cylinder (341*a*) of a low-stage side compression mechanism (340*a*). The same components as in the first embodiment are denoted by the same reference characters, and description thereof is omitted.

Figure 9:
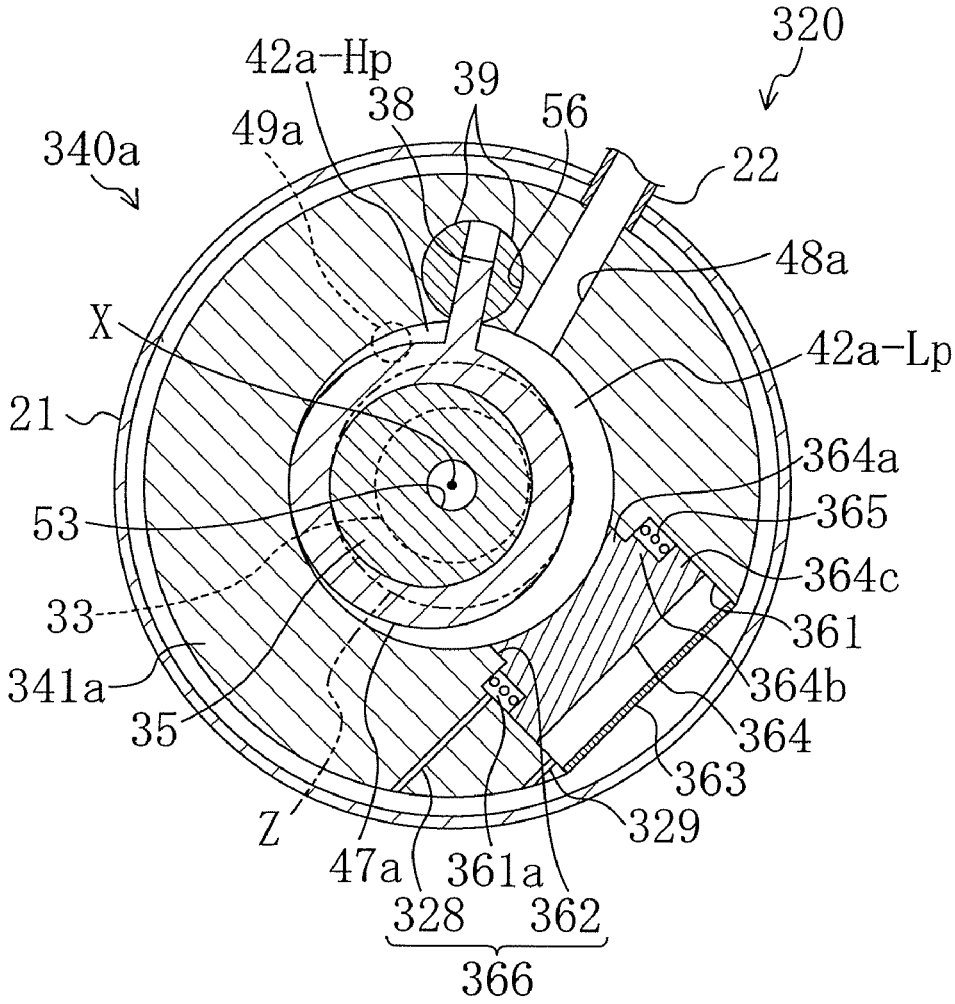
FIG. 9 is a lateral cross-sectional view showing the construction of a low-stage side compression mechanism according to a third embodiment.

As shown in FIG. 9, the two-stage compressor (320) of the third embodiment is configured such that a valve-containing hole (361) and a bypass hole (362) are formed in not a rear head but the sidewall of the low-stage side cylinder (341*a*). The valve-containing hole (361) and the bypass hole (362) are sequentially formed in the sidewall of the low-stage side cylinder (341*a*) radially from outside toward the rotational axis (X). While the bypass hole (362) is opened in the inner circumferential surface of the low-stage side cylinder (341*a*), the valve-containing hole (361) is opened in the outer circumferential surface of the low-stage side cylinder (341*a*). The valve-containing hole (361) and the bypass hole (362) are formed in a part of the sidewall of the low-stage side cylinder (341*a*) near a low-stage side suction passage (48*a*).

Figure 10:
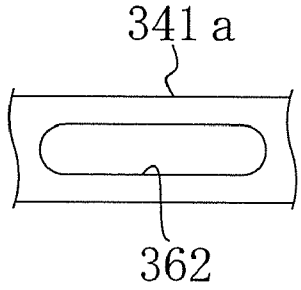
FIG. 10 is a front view of a bypass passage.

As shown in FIG. 10, the cross section of the bypass hole (362) forms an elongated shape extending circumferentially about the rotational axis (X), and only needs to be elongated circumferentially about the rotational axis (X), for example, oval-shaped.

The valve (364) and the spring (365) are contained in the valve-containing hole (361). The radially outer end of the valve-containing hole (361) is sealed by a lid (363). The valve (364) is a columnar member whose circumferential shape is widened radially outwardly in two stages; and more particularly has a radially inner small-shape portion (364*a*), a radially intermediate middle-shape portion (364*b*), and a radially outer large-shape portion (364*c*). While the outer circumferential shape of the small-shape portion (364*a*) generally coincides with the inner circumferential shape of the bypass hole (362), the outer circumferential shape of the large-shape portion (364*c*) generally coincides with the inner circumferential shape of the valve-containing hole (361). The circumferential shape of the middle-shape portion (364*b*) is larger than that of the small-shape portion (364*a*) and smaller than that of the large-shape portion (364*c*). The middle-shape portion (364*b*) is similar in shape to the small-shape portion (364*a*) and the large-shape portion (364*c*).

When the valve (364) has been contained in the valve-containing hole (361), the valve (364) sections the space in the valve-containing hole (361) into an inner space (361*a*) located radially inwardly from the large-shape portion (364*c*) of the valve (364) and an outer space (361*b*) located radially outwardly therefrom. The spring (365) is disposed in the inner space (361*a*) while being fitted around the middle-shape portion (364*b*) of the valve (364). While a bypass pipe (328) is coupled to the inner space (361*a*), an inlet pipe (329) is coupled to the outer space (361*b*). The bypass hole (362), the inner space (361*a*) of the valve-containing hole (361), and the bypass pipe (328) form a bypass passage (366).

The distal end surface of the small-shape portion (364*a*) of the valve (364) is curved along the inner circumferential surface of the low-stage side cylinder (341*a*). In other words, the curvature radius of the small-shape portion (364*a*) of the valve (364) is generally equal to the inside diameter of the low-stage side cylinder (341*a*). Furthermore, when the middle-shape portion (364*b*) has abutted against the inner end of the valve-containing hole (361), the small-shape portion (364*a*) of the valve (364) is inserted into the bypass hole (362) to the maximum. In this case, the distal end surface of the small-shape portion (364*a*) is flush with or located slightly radially outward of the inner circumferential surface of the low-stage side cylinder (341*a*). Consequently, the distal end of the small-shape portion (364*a*) does not protrude into the low-stage side cylinder chamber (342*a*).

In a case where the bypass hole (362) is opened in the inner circumferential surface of the low-stage side cylinder (341*a*) as described above, the bypass hole (362) cannot extend along the height of the low-stage side cylinder (341*a*) because the height of the low-stage side cylinder (341*a*) depends on the volume of the low-stage side cylinder chamber (342*a*). Hence, when the bypass hole has a circular cross section, the area of its opening is limited by the height of the low-stage side cylinder (341*a*) and thus cannot be increased very much. To cope with this, in the third embodiment, the cross section of the bypass hole (362) forms an elongated shape extending circumferentially about the rotational axis (X), resulting in a sufficient increase in the area of the opening of the bypass hole (362).

<<Embodiment 4 of the Invention>>

Next, a fourth embodiment of the present invention will be described. Unlike the first embodiment, a two-stage compressor (420) of the fourth embodiment is configured such that a plurality of bypass holes are formed. The same components as in the first embodiment are denoted by the same reference characters, and description thereof is omitted.

Figure 11:
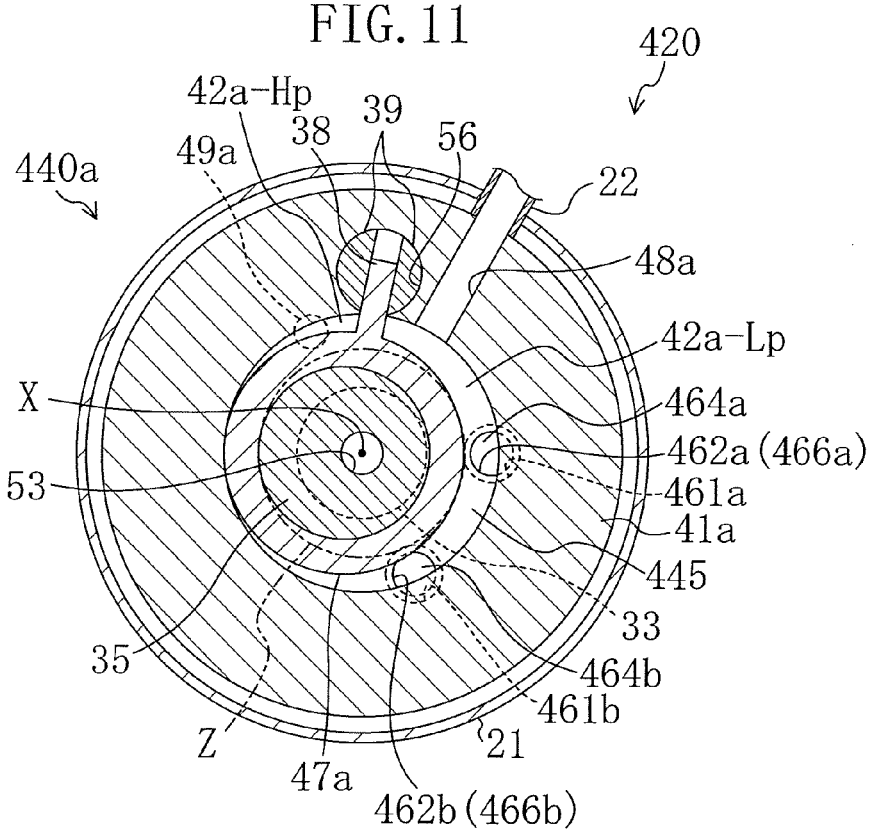
FIG. 11 is a lateral cross-sectional view showing the construction of a low-stage side compression mechanism according to a fourth embodiment.

As shown in FIG. 11, a two-stage compressor (420) of the fourth embodiment is configured such that a plurality of bypass holes (462*a*, 462*b*) are formed in a rear head (445) of a low-stage side compression mechanism (440*a*). More specifically, first and second bypass holes (462*a*, 462*b*) each have a circular cross section and are formed in a part of the top surface of the rear head (445) located outside a trajectory (Z) of an interior space of the eccentrically rotating low-stage side piston (47*a*). In this case, the first bypass hole (462*a*) is disposed at the location at which when the eccentric rotation angle of the low-stage side piston (47*a*) is approximately 90°, the bypass hole (462*a*) is blocked by the low-stage side piston (47*a*). Meanwhile, the second bypass hole (462*b*) is disposed at the location at which when the eccentric rotation angle of the low-stage side piston (47*a*) is approximately 160°, the bypass hole (462*a*) is blocked by the low-stage side piston (47*a*).

Different valves (464*a*, 464*b*) are contained in valve-containing holes (461*a*, 461*b*) communicating with the bypass holes (462*a*, 462*b*), respectively. The structures of each valve-containing hole (461*a* (461*b*)), each bypass hole (462*a* (462*b*)) and each valve (464*a* (464*b*)) are similar to those of the valve-containing hole (61), bypass hole (62) and valve (64) of the first embodiment.

Figure 12:
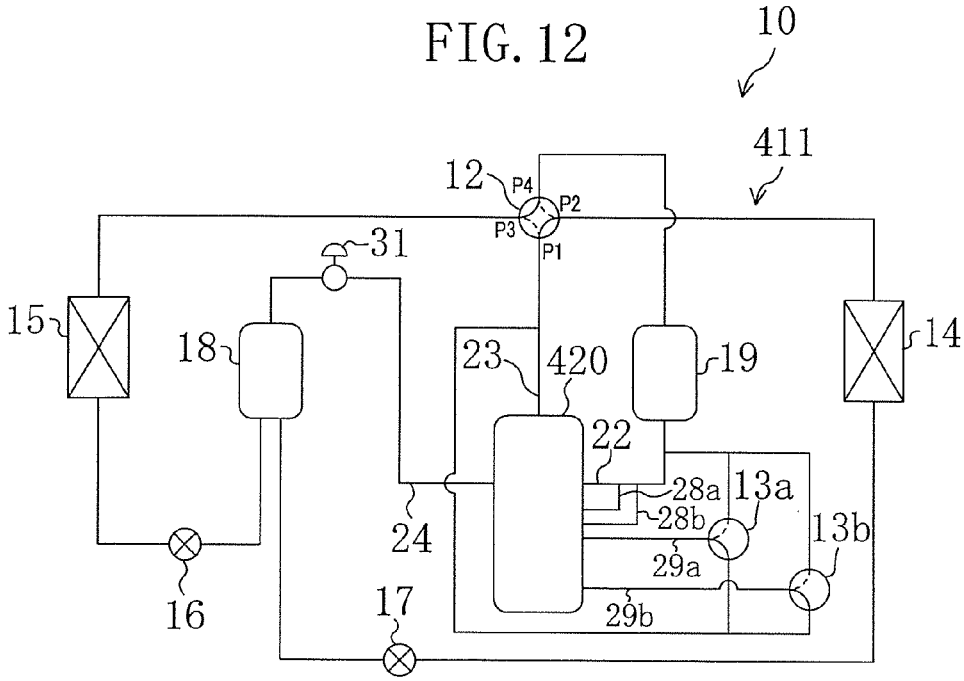
FIG. 12 is a refrigerant circuit diagram of an air conditioner.

As shown in FIG. 12, two three-way selector valves, i.e., a first three-way selector valve (13*a*) and a second three-way selector valve (13*b*), are coupled to a refrigerant circuit (411).

The first three-way selector valve (13*a*) is coupled through a first inlet pipe (29*a*) to the two-stage compressor (420) to switch between the state in which the two-stage compressor (420) communicates with a discharge pipe (23) (the state shown by the solid line in FIG. 12) and the state in which the two-stage compressor (420) communicates with a suction pipe (22) (the state shown by the broken line in FIG. 12). The downstream end of the first inlet pipe (29*a*) is coupled to a lower part of the first valve-containing hole (461*a*) below the first valve (464*a*). While the upstream end of a first bypass pipe (28*a*) is coupled to an upper part of the first valve-containing hole (461*a*) above the first valve (464*a*), the downstream end thereof is coupled to a suction pipe (22). The first bypass hole (462*a*), the upper part of the first valve-containing hole (461*a*) and the first bypass pipe (28*a*) form a first bypass passage (466*a*).

The second three-way selector valve (13*b*) is coupled through a second inlet pipe (29*b*) to the two-stage compressor (420) to switch between the state in which the two-stage compressor (420) communicates with the discharge pipe (23) (the state shown by the solid line in FIG. 12) and the state in which the two-stage compressor (420) communicates with the suction pipe (22) (the state shown by the broken line in FIG. 12). The downstream end of the second inlet pipe (29*b*) is coupled to a lower part of the second valve-containing hole (461*b*) below the second valve (464*b*). While the upstream end of a second bypass pipe (28*b*) is coupled to an upper part of the second valve-containing hole (461*b*) above the second valve (464*b*), the downstream end thereof is coupled to the suction pipe (22). The second bypass hole (462*b*), the upper part of the second valve-containing hole (461*b*) and the second bypass pipe (28*b*) form a second bypass passage (466*b*).

In other words, the opening/closing of each of the first and second bypass passages (466*a*, 466*b*) is controlled individually by a corresponding one of the first three-way selector valve (413*a*) and the second three-way selector valve (413*b*). Open and closed conditions of the first and second bypass passages (466*a*, 466*b*) are variously changed, thereby adjusting the volume ratio K of the suction volume V1 of the low-stage side compression mechanism (440*a*) to the suction volume V2 of the high-stage side compression mechanism (40*b*) (=V2/V1).

More particularly, on the first operating condition in which the pressure difference between refrigerant sucked into the two-stage compressor (420) and refrigerant discharged from the two-stage compressor (420) is relatively large, the first and second bypass passages (466*a*, 466*b*) are both closed. This condition is referred to as a first open/closed condition. On this condition, the low-stage side compression mechanism (440*a*) has the maximum suction volume V1 while having the minimum volume ratio K.

Next, on the second operating condition in which the pressure difference between refrigerant sucked into the two-stage compressor (420) and refrigerant discharged from the two-stage compressor (420) is smaller than that on the first operating condition, the first bypass passage (466*a*) is open while the second bypass passage (466*b*) is closed. This condition is referred to as a second open/closed condition. On this condition, the low-stage side compression mechanism (440*a*) has the second largest suction volume V1 while having the second smallest volume ratio K.

Furthermore, on the third operating condition in which the pressure difference between refrigerant sucked into the two-stage compressor (420) and refrigerant discharged from the two-stage compressor (420) is smaller than that on the second operating condition, the first bypass passage (466*a*) is closed while the second bypass passage (466*b*) is open. This condition is referred to as a third open/closed condition. On this condition, the low-stage side compression mechanism (440*a*) has the third largest suction volume V1 while having the third smallest volume ratio K.

Moreover, on the fourth operating condition in which the pressure difference between refrigerant sucked into the two-stage compressor (420) and refrigerant discharged from the two-stage compressor (420) is smaller than that on the third operating condition, the first and second bypass passages (466*a*, 466*b*) are open. This condition is referred to as a fourth open/closed condition. On this fourth operating condition, the timing when the low-stage side piston (47*a*) blocks the second bypass hole (462*b*) to complete the containment of refrigerant in the high-pressure chamber (42*a*-Hp) is identical with that on the third operating condition. Meanwhile, the areas of the openings of the first and second bypass holes (462*a*, 462*b*) are summed as the area of the opening or openings of open bypass hole or holes. This can ensure a sufficient refrigerant ejection flow. Consequently, the suction volume V1 of the low-stage side compression mechanism (440*a*) can approach a designed value. In other words, since, on the third operating condition, the area of the opening of only the second bypass hole (462*b*) is insufficient, the suction volume V1 of the low-stage side compression mechanism (440*a*) immediately after completion of the refrigerant containment in the high-pressure chamber (42*a*-Hp) becomes larger than the actual volume of the high-pressure chamber (42*a*-Hp). In summary, the low-stage side compression mechanism (440*a*) has the minimum suction volume V1 while having the maximum volume ratio K.

In other words, the volume ratio K increases as the open/closed condition varies from the first open/closed condition to the fourth open/closed condition.

In the above-mentioned manner, the open/closed conditions of the first and second bypass passages (466*a*, 466*b*) are changed depending on the pressure difference between refrigerant sucked into the two-stage compressor (420) and refrigerant discharged from the two-stage compressor (420), thereby adjusting the volume ratio K. Consequently, the balance of a refrigerant compression stroke between the low-stage side compression mechanism (40*a*) and the high-stage side compression mechanism (40*b*) is adjusted.

In view of the above, according to the fourth embodiment, the formation of a plurality of bypass passages (466*a*, 466*b*) can increase the total area of the openings of the bypass holes (462*a*, 466*b*).

Furthermore, the suction volume V1 of the low-stage side compression mechanism (40*a*) can be finely adjusted by individually controlling the open/closed conditions of the plurality of the bypass passages (466*a*, 466*b*). As a result, the two-stage compressor (420) can be operated under circumstances where the volume ratio K of the suction volume V1 of the low-stage side compression mechanism (40*a*) to the suction volume V2 of the high-stage side compression mechanism (40*b*) is adjusted according to the pressure difference between refrigerant sucked into the two-stage compressor (420) and refrigerant discharged from the two-stage compressor (420).

Although in the fourth embodiment the cross sections of the bypass holes (462*a*, 462*b*) are circular, this is not restrictive. For example, as in the first embodiment and its modification, the cross sections thereof may be arched, elongated or oval or form any other arbitrary shape.

<<Other Embodiments>>

The above embodiments of the present invention may be configured as follows.

More particularly, although the first through fourth embodiments are directed to a two-stage compressor having a low-stage side compression mechanism and a high-stage side compression mechanism, this is not restrictive. The present invention can be used also for, for example, a single-stage compressor having a single compression mechanism.

Although each compression mechanism is provided with only one bypass passage, this is not restrictive. A single compression mechanism may be provided with a plurality of bypass passages, and thus the containment volume of the compression mechanism may be adjusted in a plurality of stages.

Furthermore, although the cross sections of the bypass hole and valve are circular, this is not restrictive. The cross sections may form an arbitrary shape.

Moreover, although in the first through fourth embodiments the bypass hole or holes and valve are disposed in the rear head or the front head, this is not restrictive. The bypass hole or holes and valve may be disposed in the middle plate.

Although the first through fourth embodiments are directed to a rolling piston rotary compressor as a compression mechanism, this is not restrictive. The embodiments may be directed to, for example, a rotary compressor which includes a cylinder and a piston contained in the cylinder as in the first through fourth embodiments and whose piston eccentrically rotates without rotating on its axis. Alternatively, they may be directed to a compressor including a cylinder having an outer cylinder part and an inner cylinder part with an annular compression chamber formed therebetween and an annular piston contained in the compression chamber while being eccentric with respect to the cylinder and sectioning the compression chamber into the outer compression chamber and the inner compression chamber. The compressor compresses refrigerant in an outer compression chamber and an inner compression chamber in such a manner that one of the cylinder and the piston eccentrically rotates while swinging. In summary, the present invention can be used for any arbitrarily-constructed compressor for compressing refrigerant by a movable member eccentrically rotating relative to a fixed member.

The above embodiments are mere essentially preferable examples, and are not intended to limit any scopes of the present invention, applicable subjects, and usage.

INDUSTRIAL APPLICABILITY

As described above, the present invention is useful for compressors including a compression mechanism having a bypass passage through which refrigerant is partially ejected from a compression chamber so as to be returned to a suction side of the compression mechanism.

What is claimed is:

1. A compressor comprising:

a low-stage side compression mechanism configured to compress refrigerant sucked from outside;

a high-stage side compression mechanism configured to suck refrigerant discharged from the low-stage side compression mechanism and to compress the sucked refrigerant;

an injection pipe configured to lead intermediate pressure gas refrigerant in a refrigeration cycle into the high-stage side compression mechanism;

two end plates with each end plate having a flat surface, the two end plates being disposed with the flat surfaces opposed to each other;

a fixed member disposed between the two end plates;

a movable member disposed between the two end plates and arranged to eccentrically move about a predetermined rotational axis to form a compression chamber of one of the low-stage side compression mechanism and the high-stage side compression mechanism between the fixed member and the movable member;

a bypass passage having an upstream end opened to the compression chamber through which refrigerant is partially ejected from the compression chamber so as to be returned to a suction side of the one of the low-stage side compression mechanism and the high-stage side compression mechanism having the compression chamber; and an opener/closer arranged to open/close the bypass passage, the opener/closer being arranged to open the bypass passage when a pressure difference between the refrigerant sucked into the low-stage side compression mechanism and the refrigerant discharged from the high-stage side compression mechanism is below a predetermined value, and to close the bypass passage when the pressure difference between the refrigerant sucked into the low-stage side compression mechanism and the refrigerant discharged from the high-stage side compression mechanism is above the predetermined value, the upstream end of the bypass passage having a cross section that is elongated circumferentially about the rotational axis.

2. The compressor of claim 1, wherein the cross section of the upstream end of the bypass passage is curved circumferentially about the rotational axis.

3. The compressor of claim 1, wherein the cross section of the upstream end of the bypass passage is elongated along a direction orthogonal relative to a radial direction that extends radially from the rotational axis.

4. The compressor of claim 1, wherein the cross section of the upstream end of the bypass passage forms an oval shape with a major axis orthogonal relative to a radial direction that extends radially from the rotational axis.

5. The compressor of claim 1, wherein an opening of the bypass passage is formed in one of the end plates.

6. The compressor of claim 1, wherein the fixed member has a cylindrical shape with an inner circumferential surface in sliding contact with the movable member, and an opening of the bypass passage is formed in the inner circumferential surface of the cylindrical shaped fixed member.

7. The compressor of claim 1, wherein:

the bypass passage includes a plurality of bypass passages with upstream ends opened to the compression chamber through which refrigerant in the compression chamber is partially ejected so as to be returned to the suction side of one of the low-stage side compression mechanism and the high-stage side the compression mechanism; and the opener/closer includes a plurality of openers/closers arranged to open/close the bypass passages.

* * * * *